US008973707B2

(12) United States Patent
Kreller

(10) Patent No.: US 8,973,707 B2
(45) Date of Patent: Mar. 10, 2015

(54) TOE BOARD FOR SCAFFOLDING AND A METHOD FOR PRODUCING A TOE BOARD

(75) Inventor: Helmut Kreller, Bad Rappenau (DE)

(73) Assignee: Wilhelm Layher Verwaltungs-GmbH, Gueglingen-Eibensbach (DE)

( * ) Notice: Subject to any disclaimer, the term of this patent is extended or adjusted under 35 U.S.C. 154(b) by 1195 days.

(21) Appl. No.: 12/448,957

(22) PCT Filed: Jan. 21, 2008

(86) PCT No.: PCT/DE2008/000097
§ 371 (c)(1),
(2), (4) Date: Jul. 16, 2009

(87) PCT Pub. No.: WO2008/089731
PCT Pub. Date: Jul. 31, 2008

(65) Prior Publication Data

US 2010/0078264 A1 Apr. 1, 2010

(30) Foreign Application Priority Data

Jan. 23, 2007 (EP) ..... 07001361

(51) Int. Cl.
*E04G 5/14* (2006.01)
*E04G 7/28* (2006.01)

(52) U.S. Cl.
CPC ..... *E04G 7/28* (2013.01)
USPC ..... 182/113; 182/112; 182/222; 29/505

(58) Field of Classification Search
USPC ..... 182/112, 113, 222, 45, 129, 106, 151, 182/178.1, 187, 223, 230; 256/59; 29/505
See application file for complete search history.

(56) References Cited

U.S. PATENT DOCUMENTS

| | | | | | |
|---|---|---|---|---|---|
| 4,496,029 | A * | 1/1985 | Kuroda | 182/222 |
| 4,620,612 | A * | 11/1986 | Enoki et al. | 182/113 |
| 4,766,975 | A * | 8/1988 | Whitson | 182/150 |
| 5,704,449 | A * | 1/1998 | Ono | 182/119 |
| 5,775,463 | A * | 7/1998 | Alberts | 182/113 |
| 6,076,991 | A * | 6/2000 | Karlsen et al. | 403/381 |
| 6,105,723 | A * | 8/2000 | D'Alessio | 182/222 |
| 6,405,830 | B1 * | 6/2002 | Hayman | 182/113 |
| 6,976,557 | B2 * | 12/2005 | Becker | 182/113 |

(Continued)

FOREIGN PATENT DOCUMENTS

| | | |
|---|---|---|
| DE | 1 960 069 | 5/1967 |
| DE | 37 02 127 | 8/1988 |
| DE | 37 18 253 | 12/1988 |

(Continued)

OTHER PUBLICATIONS

European Office Action dated Jul. 3, 2007 with English translation of relevant parts.

(Continued)

*Primary Examiner* — Daniel Cahn
(74) *Attorney, Agent, or Firm* — Collard & Roe, P.C.

(57) ABSTRACT

A toe board of a scaffold system and a method of producing the toe board, the toe board configured to be attached to a working or walking surface of the scaffold in order to limit lateral movement upon the surface, the toe board made from a steel board unit having a hollow profile enclosed by covers and mounting units inserted at each end with multiple types of fastenings.

45 Claims, 25 Drawing Sheets

(56) References Cited

U.S. PATENT DOCUMENTS

| | | | | |
|---|---|---|---|---|
| 2004/0040788 | A1* | 3/2004 | Bothwell et al. | 182/222 |
| 2005/0189173 | A1* | 9/2005 | Becker | 182/113 |

FOREIGN PATENT DOCUMENTS

| | | |
|---|---|---|
| DE | 38 13 513 | 11/1989 |
| DE | 295 01 982 | 5/1995 |
| DE | 295 06 672 | 6/1995 |
| DE | 202 02 659 | 5/2002 |
| DE | 100 61 506 | 6/2002 |
| JP | 08-326296 | 12/1996 |
| JP | 2005-139663 | 6/2005 |
| RU | 2 160 813 | 12/2000 |

OTHER PUBLICATIONS

European Office Action dated May 20, 2008 with English translation of relevant parts.

Layher, "*Layher allround Geruest Zulassungsbescheid*," [Layher allround scaffolding permission notification] Nov. 11, 1987, Deutches Institut fur Bautechnik, Berlin, pp. 72-73. XP-002438969. (ISR) (European OAs).

International Search Report.

* cited by examiner

TOE BOARD FOR SCAFFOLDING AND A METHOD FOR PRODUCING A TOE BOARD

CROSS REFERENCE TO RELATED APPLICATIONS

This application is the National Stage of PCT/DE2008/000097 filed on Jan. 21, 2008, which claims priority under 35 U.S.C. §119 of European Application No. 07001361.0 filed on Jan. 23, 2007. The international application under PCT article 21(2) was not published in English.

The invention relates to a toe board for scaffolding, for enclosing walk and/or work surfaces of scaffolding platforms or scaffolding floors on a lateral side of the walk and/or work surfaces, with an elongate board unit, which is formed by or from a hollow profile of steel, particularly of galvanised steel plate, which with the help of a respective closure means is closed at each of its ends facing away from one another in longitudinal direction. For producing a connection with the scaffolding and/or with an adjacent toe board, the toe board has a mounting unit protruding in longitudinal direction beyond its respective end and consisting of metal, preferably of steel, particularly of sheet steel.

Toe boards are provided at the edges of scaffolding floors so as to prevent persons from slipping off at the side and/or objects from dropping down. They comprise a board body which hitherto usually consisted of solid material and, in particular, of wood, synthetic material or aluminium. Fittings of steel or aluminium, preferably of sheet material, serving for production of a connection with the scaffolding and/or with an adjacent toe board are fastened to the longitudinal ends of the board body with the help of rivets or screws. Toe boards of that kind have become known from, for example, DE 1 960 069 U, DE 37 02 127 A1, DE 38 13 513 A1, DE 202 02 659 A1 and DE 295 06 672 U1.

A toe board of steel has become known from DE 295 01 982 U1, which consists of pressed steel panels with drawn-through holes or of rolled steel panels with drawn-in corrugations, which are cut at the ends thereof and closed by flat steel. Welded to the flat steel are U-shaped retaining brackets with the help of which the steel toe boards can be fixed to vertical upright tubes of a scaffolding. With steel toe boards of that kind it is possible to achieve, by comparison with toe boards of wood or of aluminium, a longer service life because they are in a position of also being able to securely withstand the loads occurring under rough conditions in practice, such as can arise particularly during transport and handling of the toe boards, especially when throwing, dropping and/or possible walking thereon in the course of assembly or disassembly.

As in the case of aluminium toe boards the fire load can be minimised with the use of toe boards of steel by comparison with toe boards of wood. However, steel toe boards can be produced very much more economically by comparison with aluminium toe boards, which are expensive with respect to material and production. Steel toe boards are usually galvanised for the purpose of surface protection.

However, the steel toe boards which have become known from the prior of the art are still comparatively costly in production and due to sharp burrs in the edge region the manual handling thereof is connected with a considerable risk of injury.

It is accordingly an object of the invention to provide a toe board for scaffolding with a board unit of steel and a method for production of a toe board, by which the foregoing disadvantages are avoided.

This object is fulfilled by a toe board with the features described herein and by a method for production of a toe board as described herein.

Due to the fact that the hollow profile of the board unit is closed at each of its ends by a respective end cap comprising a cover part which projects beyond the end of the hollow profile and covers the end edges thereof and which consists preferably substantially or preferably entirely of synthetic material or aluminium, the risk of injury during handling can be minimised. Since the end cap has a fastening body connected in single-part or multi-part manner with the cover part thereof, the cover part being inserted into the hollow profile of the board unit and being firmly connected therewith and/or with the mounting unit with the help of fastening means, it is possible to achieve a simple and economic assembly as well as secure connection with the board unit. Due to the fact that the mounting unit has a fastening part which is inserted into the hollow profile, preferably also into a recess, particularly into a slot, of the end cap and which is firmly connected with the hollow profile with the help of fastening means, a particularly advantageous assembly in conjunction with economic connecting techniques as well as a secure connection of the parts forming the toe board can also be achieved together with the effect of a further reduction in the risk of injury.

It can be of particular advantage if the fastening part or the mounting unit is inserted into the hollow profile to penetrate a recess, particularly a slot, of the end cap. The risk of injury during handling can thereby be even further reduced.

In a particularly advantageous development provision can be made for the wall parts, which bound the recess or the slot, of the end cap to enclose the fastening part of the mounting unit over the full circumference or substantially over the full circumference. As a result, not only can the risk of injury by sharp end edge regions be further reduced, but also advantageous possibilities of assembly and fixing of the mounting unit to the end cap itself arise.

In an advantageous development it can be provided that the fastening body also is composed preferably substantially or preferably entirely of synthetic material or aluminum and is preferably integrally connected with the cover part. This enables particularly economic production of the end cap.

If the cover part, preferably also the fastening body, is or are formed substantially or entirely from or by a thermoplastic synthetic material these components can be produced even more economically, particularly in an injection-moulding method.

Although the end cap and/or the fastening body can be preferably formed from a raw synthetic material already securely resistant to the demands and loads in practice, provision can also be made for the end cap and/or the fastening body to consist substantially or entirely of a synthetic material filled with fillers and/or reinforced by reinforcing materials, preferably by reinforcing fibers, especially by glass fibers.

In a preferred development it can be provided that the mounting unit and/or the end cap is or are mechanically positively connected, i.e. connected with shape-fit, with the hollow profile or with formation of a mechanically positive connection, i.e. a shape-fit connection. A particularly stable and secure connection of the components to be connected and consequently a toe board doing particular justice to the demands and loads in practice can thereby be made available. Alternatively or additionally it can also be provided for this purpose that the mounting unit and the end cap are mechanically positively connected together, i.e. connected with shape-fit, with shape-fit or connected together with formation of a mechanically positive connection, i.e. a shape-fit connection.

The afore-mentioned advantages can be further improved if the mounting unit and/or the end cap is or are fastened to the hollow profile of the board unit exclusively with the help of mechanical fastening means and free of welding.

An even more stable and secure connection of the components to be connected and consequently a toe board doing justice to a particular degree to the demands and loads in practice can be achieved if the mounting unit and/or the end cap is or are fastened to the hollow profile of the board unit by means of rivets, particularly by means of tubular rivets. A toe board with a particularly high load-bearing capability can thereby be made available.

The mounting unit and/or the end cap can be preferably fastened to the hollow profile of the board unit by means of at most or exactly two rivets, preferably by means of at most or exactly two tubular rivets.

Alternatively, it can be provided that the mounting unit and/or the end cap is or are fastened to the hollow profile of the board unit free of welding and free of separate mechanical fastening means, such as rivets or screws. As a result, separate joining materials or fastening elements can be eliminated, whereby a particularly economic mass production is made possible.

In a particularly advantageous embodiment provision can additionally be made for the mechanically positive connection to be achieved by a pressing process producing a local deformation of a wall part of the hollow profile.

According to a particularly preferred development it can be provided that the mechanically positive connection is effected by drawing in or pressing in a hole edge region of a hole provided in a wall part of the hollow profile, preferably with the help of a press die, into a recess, preferably into a passage hole, of the fastening part of the mounting unit and/or of the fastening body of the end cap. These measures enable a particularly economic production of the toe board with further improved stiffness as well as with a further reduced weight.

In a particularly preferred embodiment provision can be made for the fastening part of the mounting unit and/or of the fastening body of the end cap to have at least one recess, preferably a passage hole, extending transversely to a wall part of the hollow profile and open towards the wall part, the recess edge or hole edge being engaged behind by a hole edge—which is integrally connected or integrally formed with the wall part of the hollow profile and which projects inwardly, preferably is drawn in—of a hole of the hollow profile.

In a further advantageous embodiment it can be provided that the mounting unit and the end cap are mechanically positively connected together prior to insertion of the fastening part and the fastening body into the hollow profile of the board unit. Special assembly and production advantages can thereby be achieved.

In addition, provision can be made for the fastening body of the end cap to be formed with a resilient detent element which in the mounted state so detents in a recess, preferably in a passage opening, of the fastening part of the mounting unit with formation of a mechanically positive connection that the fastening part of the mounting unit mounted at the end cap is secured at least against withdrawal in a direction opposite to the direction of insertion of the fastening body of the end cap into the hollow profile. In this manner the mounting unit and the end cap can be pre-assembled in particularly simple mode and manner with formation of a unit which is simple and safe to handle.

In that case provision can be made for the fastening part of the mounting unit during its plugging onto or into the end cap to press the resilient detent element of the fastening body of the end cap inwardly against the spring forces of the detent element, wherein in the course of further plugging on or plugging in of the fastening part of the mounting unit the detent element of the fastening body of the end cap automatically detents in the recess of the fastening part of the mounting unit.

In addition, it can be provided that the end cap has an abutment against which the fastening part of the mounting unit can abut during plugging onto or into the end cap so that the mounting unit in the mounted state is disposed in a position relative to the end cap which is predetermined by the position of the abutment.

In that case, it can be provided in an advantageous embodiment that the abutment and the detent element of the end cap are arranged at a spacing from one another which is equal to or slightly larger than the spacing between the recess, which is associated with the detent element, of the fastening part of the mounting unit and an end edge, which is associated with the abutment, of the fastening part of the mounting unit. In this manner, after joining together or plugging together of the mounting unit and the end cap a unit results which can be handled simply and safely in the course of the of the further production process and which is permanently connected for the loads then encountered.

Moreover, provision can be made for the recess of the fastening part of the mounting unit to be formed as a slot extending in the insertion direction and for the detent element to have an outer contour corresponding with the inner contour of the slot. Precise positioning of the components, which are to be pre-assembled, is thereby further improved.

In addition, it can be provided that the fastening part of the mounting unit is formed with at least two fastening limbs arranged at a spacing from and preferably parallel to one another. The weight of the mounting unit can thereby be advantageously reduced.

In that case it can be provided that each fastening limb is formed with at least one recess serving for fastening thereof to the hollow profile and with at least one recess serving for fixing thereof relative to the end cap. This enables a particularly secure fixing of the end cap relative to the mounting unit on the one hand and a secure and stable connection of the mounting unit with the hollow profile of the board unit on the other hand.

Furthermore, provision can be made for the fastening body of the end cap to be formed with at least two insertion bodies arranged at a spacing from one another and preferably also parallel to one another, wherein the number of insertion bodies preferably corresponds with the number of fastening limbs.

In an advantageous embodiment it can be provided that the end cap is chamfered at an angle of preferably approximately 45 degrees at its end facing away from the hollow profile in longitudinal direction. Depending on the selected angle a further toe board can in this manner be mounted at the end directly adjoining a first toe board according to the invention. In addition, in this manner the board unit or the hollow profile can be cut to length particularly economically in a cutting plane perpendicular to the length direction thereof.

In addition, provision can be made for the part of the cover part covering the end edges of the hollow profile to be formed with an abutment which can be brought into contact with the end edges of the hollow profile or bears thereagainst. Through an abutment of that kind the precise insertion position of the end cap or of the fastening body thereof can be determined so that a uniform overall length of the toe board can always be guaranteed in the course of production thereof.

In addition, it can be provided that the end edges of the hollow profile span a plane arranged perpendicularly to the length direction or perpendicularly to the longitudinal axis of the hollow profile. As already mentioned beforehand, the hollow profile can be thus cut to length perpendicularly to its longitudinal axis, which means particular cost advantages in production. Thus, the connecting chamfers, which are optionally provided, of toe boards to be optionally arranged at an angle relative to one another can then be provided at the part of the end caps protruding out of the hollow profile, which in combination signifies special advantages in cost.

Moreover, provision can be made for the hollow profile to be formed with at least one, preferably with at least two, longitudinal beams which for preference are closed in cross-section. The bending, torsional and kink strengths can thereby be significantly increased.

In that case it is advantageous if the at least one longitudinal beam is constructed as an edge beam. Apart from the afore-mentioned advantages, in this manner the risk of injury during manual handling can be even further reduced. These advantages can be achieved to a particular degree if two longitudinal beams constructed as edge beams are provided.

In addition, provision can be made for the longitudinal beam to have a box-shaped and/or closed, particularly trapezium-shaped, cross-section in a section perpendicular to the longitudinal axis thereof.

Furthermore, provision can be made for the hollow profile to be produced by bending over and/or flanging a blank of steel plate, particularly in a profiling roll train. This makes possible a particularly economic production of the toe board.

A further improved connection and particularly economic production can be achieved if the two longitudinal ends of the hollow profile produced from steel plate are connected with one another in overlapping manner or in a butt joint free of separate mechanical fastening means, such as rivets or screws, and also free of welding methods requiring a separate joining material.

In that case it can be provided that the two longitudinal ends of the steel plate are connected together or with an oppositely disposed wall part of the hollow profile with the help of a press-joining method, for example by means of through-joining, clinching and/or roller cut stamping.

Alternatively or additionally provision can be made for the two longitudinal ends of the steel plate to be connected together or with an oppositely disposed wall part of the hollow profile by means of laser welding, preferably over the entire length of the steel plate.

It is possible to achieve a particularly economic mass production of the toe boards in a large batch number with use of the afore-mentioned joining methods.

In addition, it can be provided that the mounting unit has in the region projecting beyond the end of the hollow profile a slot extending substantially perpendicularly to the longitudinal axis thereof and open towards one of the narrow longitudinal end faces of the board unit extending in longitudinal direction. The slot base of the slot can preferably be arranged at approximately half the height of the board unit.

In addition, it can be provided that the board unit is provided on its wide longitudinal sides facing away from one another with longitudinal ribs which extend over or substantially over its entire length and are preferably formed as corrugations and which enable stacking of several toe boards one above the other with formation of a mechanically positive connection, which hinders or prevents displacement of the toe boards perpendicularly to the length direction thereof, of the toe boards stacked one on the other. Longitudinal ribs of that kind can thus serve as stack ribs. Moreover, the stiffness and also the capability of gripping the toe boards can be increased by longitudinal ribs of that kind.

In that case it can advantageously be provided that at least one first longitudinal rib of the longitudinal ribs extends upwardly of the outer boundary surface of a first wide longitudinal side of the wide longitudinal sides of the board unit and that at least one second longitudinal rib of the longitudinal ribs extends downwardly of the outer boundary surface of the second wide longitudinal side, which faces away from the first wide longitudinal side, of the board unit. Longitudinal ribs of that kind can be produced in particularly simple and economic mode and manner and enable a particularly simple and secure stacking of several toe boards with increased stiffness and capability of gripping of toe boards of that kind.

Moreover, provision can be made for the longitudinal ribs to be arranged in the region of at least one longitudinal beam, preferably in each instance in the region of an edge beam.

In addition, it can be provided that the longitudinal ribs have from the narrow longitudinal end face, which is associated therewith, of the board unit a spacing which enables gripping of the board unit by hand from one of its narrow longitudinal end faces in such a manner that at least one of the longitudinal ribs on a first wide longitudinal side of the wide longitudinal sides of the board unit can be gripped behind by at least one first finger of the hand or that at least one first finger of the hand can engage in at least one of the longitudinal ribs on a first wide longitudinal side of the wide longitudinal sides of the board unit, whilst at the same time another finger, preferably the thumb, of the same hand grips the second wide longitudinal side of the board unit facing away from the first wide longitudinal side. This spacing can advantageously be between 15 and 35 millimeters, preferably in the region between 20 and 30 millimeters, particularly approximately 24 millimeters.

In addition, it can be provided that the mounting unit formed from sheet steel is cranked, preferably at an angle, particularly of approximately 45 degrees or approximately 90 degrees, in its region, which projects beyond the end of the hollow profile, transversely to the longitudinal direction. It is thereby possible to minimize or completely avoid a gap, which is formed in the case of toe boards according to the prior art, between the longitudinal edge of a scaffolding covering and the boundary wall of the toe board, in that the outer boundary surface, which laterally encloses the walk and/or work surface of the scaffolding platforms, of the board unit of the toe board aligns with the longitudinal end edges of the scaffolding platforms or even projects in over the walk and/or work surface of the scaffolding platform or partly covers this. In the case of a cranking of approximately 90 degrees, in which thus a wall part or limb of the fixing part of the mounting unit is thus bent or flanged over approximately perpendicularly to the fastening part or the fastening limb thereof it is possible to achieve an advantageous securing of the toe board against longitudinal displacement.

In a preferred embodiment it can be provided that the mounting unit consists of a steel plate cranked by bending at least twice. A steel plate of that kind can be produced particularly simply and economically, has a low weight and can, nevertheless, advantageously satisfy the demands, which are imposed on a mounting unit of that kind, with respect to function and purpose of use.

The invention also relates to scaffolding comprising scaffolding floors or scaffolding platforms, which have walk and/or work surfaces, and vertical posts with first connector units for connection of longitudinal rails and/or transverse rails and/or diagonals with the help of second connecting units as well as at least one toe board as described herein. The object of the invention mentioned in the introduction can also thereby be advantageously fulfilled.

In a scaffolding of that kind it can advantageously be provided that the first connecting unit is constructed as a rosette, particularly as an apertured disc, which surrounds a vertical post and has recesses, and that the second connector unit is formed as a connecting head, which can be plugged onto the rosette and which has at least one wedge opening for insertion of a connecting wedge serving for tightening to the rosette.

Moreover, provision can be made for the connecting head, which has vertical outer boundary surfaces running together in wedge-like manner, to have an upper head part and a lower head part, between which a forwardly open slot for plugging of the connecting head onto the rosette is provided.

The invention also relates to a method for producing a toe board, which has, features as described herein, for scaffolding, for lateral enclosing of walk and/or work surfaces of scaffolding platforms, comprising an elongate board unit, which is formed by or from a hollow profile of steel, particularly of galvanised steel, which with the help of respective closure means is closed at each of its ends facing away from one another in longitudinal direction and which for producing a connection with the scaffolding and/or with an adjacent toe board is provided with a mounting unit protruding in longitudinal direction beyond its respective end and consisting of metal, preferably of steel, particularly of sheet steel, wherein the hollow profile of the board unit is closed at each end thereof by a respective end cap comprising a cover part which protrudes beyond the end of the hollow profile and covers the end edges thereof and which is composed preferably substantially or preferably entirely of plastics material, the cap having a fastening body which is connected in single-part or multi-part manner with the cover part and which is inserted into the hollow profile and firmly connected therewith and/or with the mounting unit with the help of fastening means, and that the mounting unit has a fastening part which is inserted into the hollow profile to penetrate, for preference, a recess, particularly a slot, of the cover part and which is firmly connected with the hollow profile of the board unit with the help of fastening means.

According to a first embodiment of this method it can be provided that the mounting unit and/or the end cap is or are connected with the hollow profile by a pressing process, which produces a local deformation of a wall part of the hollow profile, with formation of a mechanically positive connection.

In that case it can advantageously be provided that the mechanically positive connection is produced by drawing in or pressing in a hole edge of a hole, which is provided in a wall part of the hollow profile, with the help of a press die into a recess, preferably into a passage hole, of the fastening part of the mounting unit and/or of the fastening body.

Alternatively or additionally it can be provided that the mechanically positive connection of the mounting unit with the hollow profile and the mechanically positive connection of the end cap with the hollow profile are produced under the action, preferably simultaneously, of several press dies engaging the hollow profile on longitudinal sides thereof, which face away from one another, in opposite directions.

According to a second embodiment or according to a development of the method, which is described in the foregoing, for producing a toe board, particularly having features as described herein, or additionally, it can be provided that the mounting unit and/or the end cap is or are fastened to the hollow profile of the board unit exclusively by way of mechanical fastening means and free of welding.

According to a third embodiment or according to a development of the method, which is described in the foregoing, for producing a toe board, particularly having features described herein, it can be provided that the mounting unit and/or the end cap is or are fastened to the hollow profile of the board unit by means of rivets, preferably by means of tubular rivets.

In an advantageous embodiment of the method or of the method of producing a toe board, particularly having features described herein, the following assembly steps can be provided:

- initially the mounting unit and the end cap are firmly connected together, wherein the fastening body of the end cap and the fastening part of the mounting unit form an insertion unit;
- subsequently the insertion unit is inserted into the hollow profile; and
- subsequently thereto the fastening part of the mounting unit, preferably also the fastening body of the end cap, is or are firmly connected with the hollow body.

Further features, aspects and advantages of the invention can be inferred from the following description part, in which preferred exemplifying embodiments of the invention are described in more detail on the basis of the drawings, in which.

Figure 1:
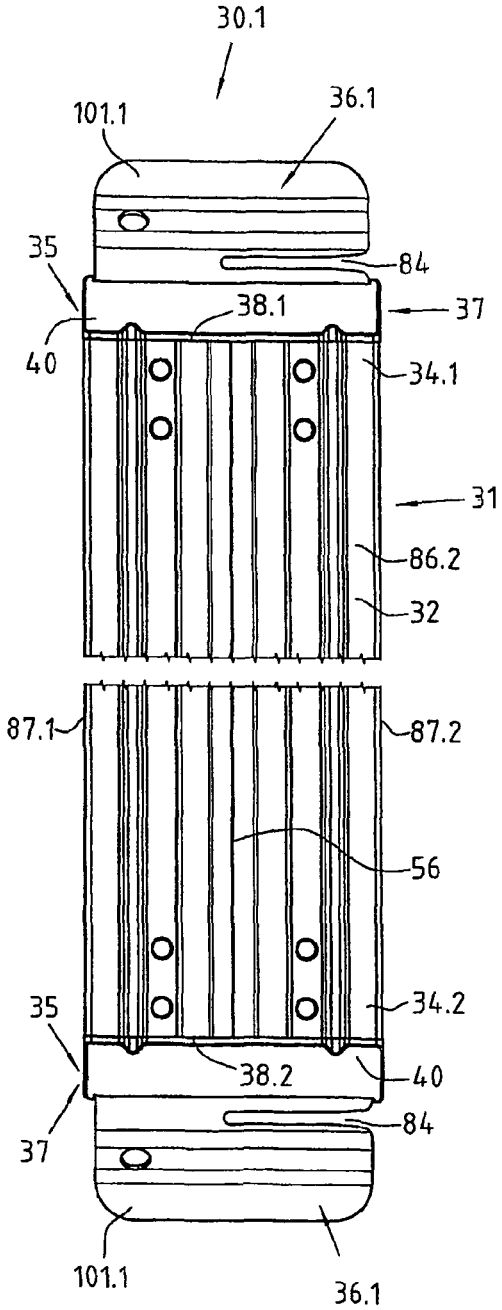
FIG. 1 shows a side view of a toe board with a view of one of the wide longitudinal sides thereof, with a mounting unit according to a first variant of embodiment.
Figure 3:
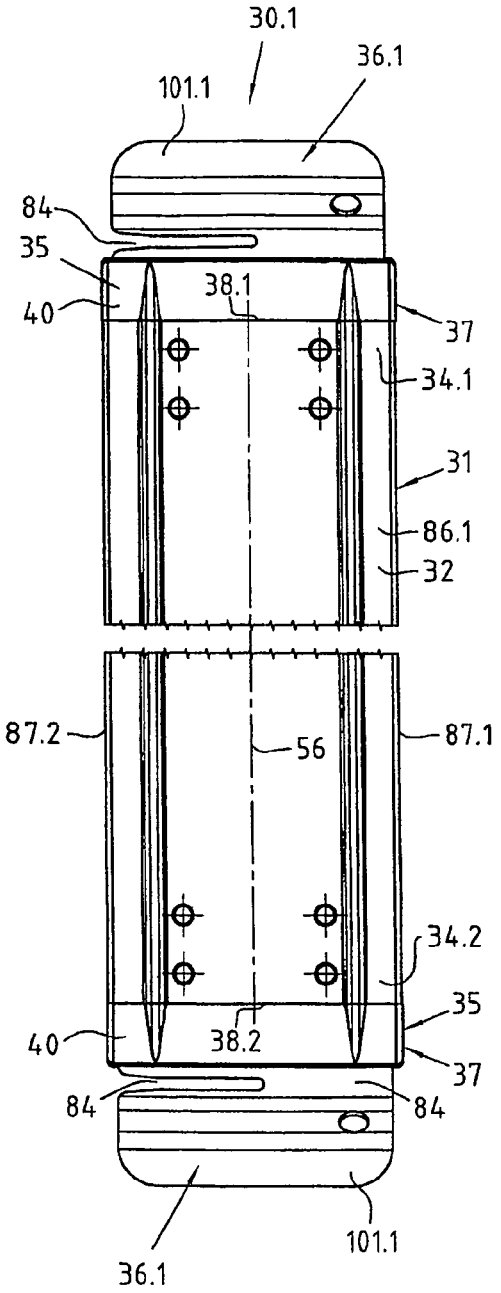
FIG. 3 shows a side view of the toe board according to FIG. 1 with a view of the other wide longitudinal side thereof.
Figure 18:
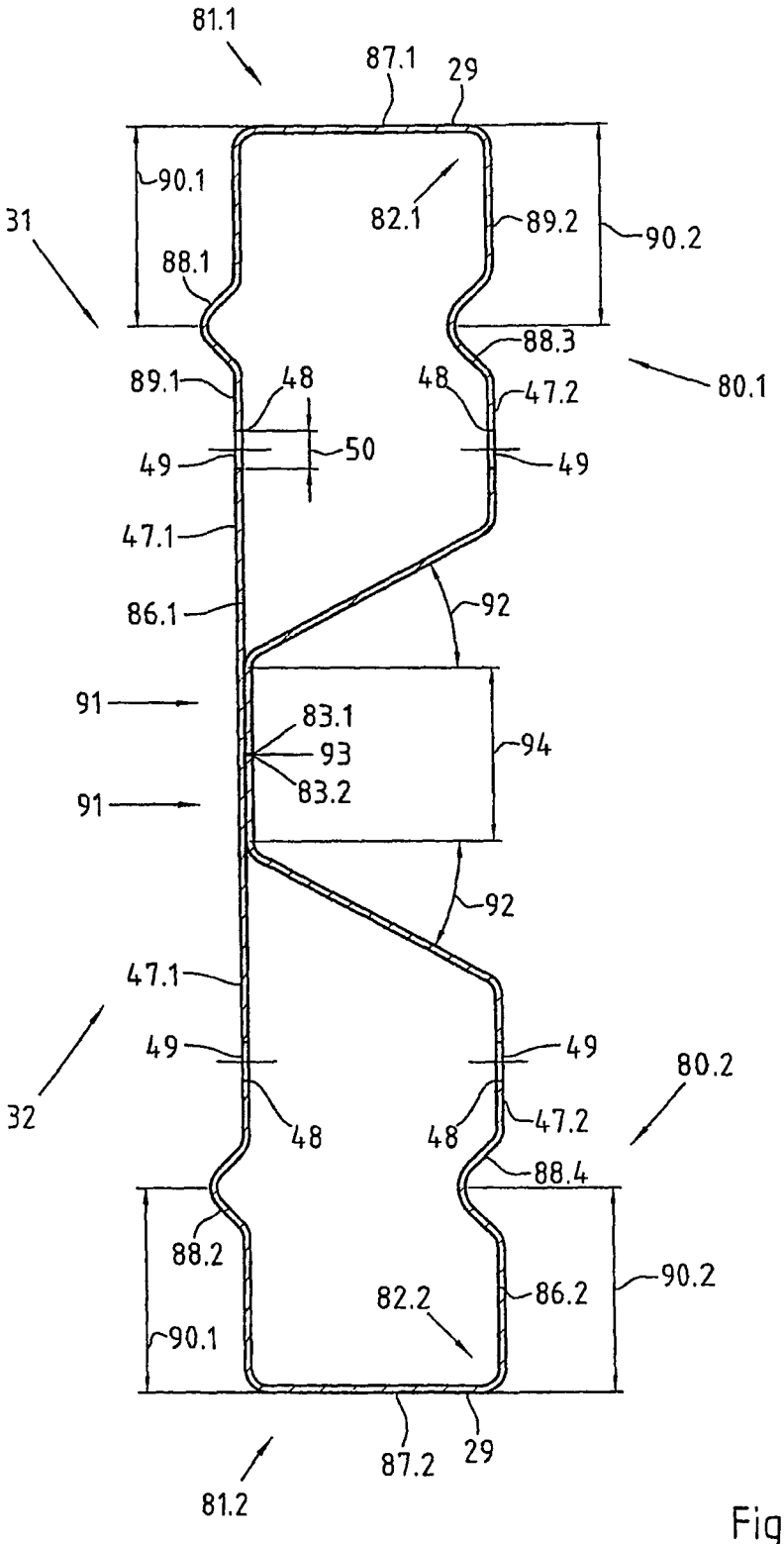
FIG. 18 shows a cross-section, which extends perpendicularly to the longitudinal axis of the board unit, of the hollow profile, with illustration of the fastening holes thereof in the state prior to assembly and mechanically positive fastening of the end cap.
Figure 19:
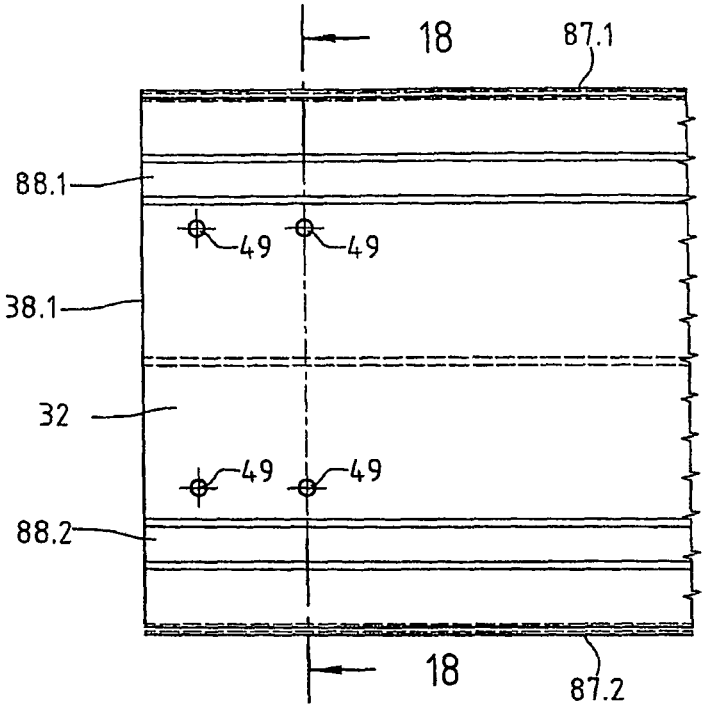
FIG. 19 shows a plan view of a detail of the board unit according to FIG. 18 with a view of the wide longitudinal side shown on the right in FIG. 18.
Figure 20:
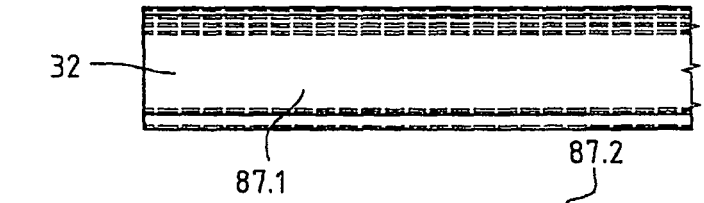
FIG. 20 shows a side view of a detail of the board unit according to FIG. 18 with a view of the narrow longitudinal side shown at the top in FIG. 18.
Figure 21:
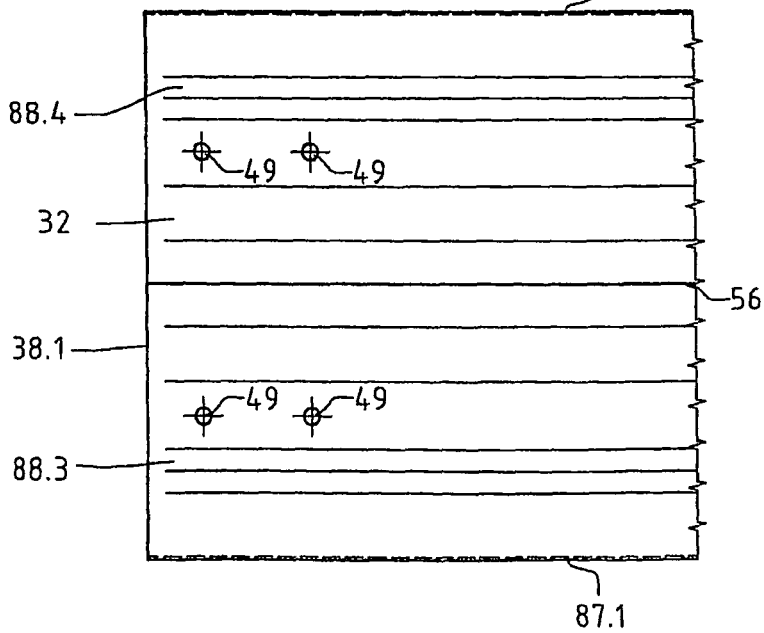
FIG. 21 shows a side view of a detail of the board unit according to FIG. 18 with a view of the wide longitudinal side shown on the right in FIG. 18.
Figure 22:
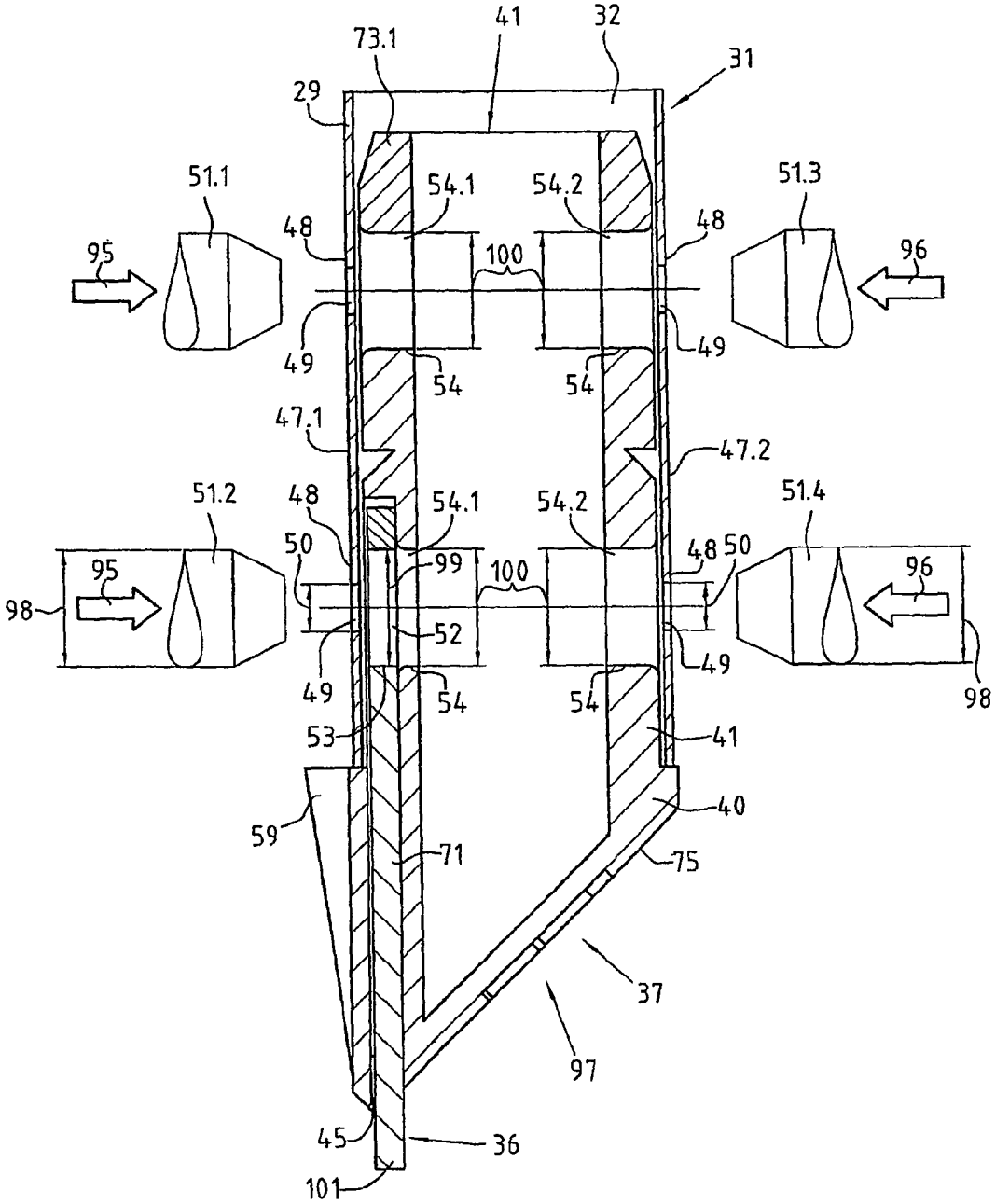
Figure 23:
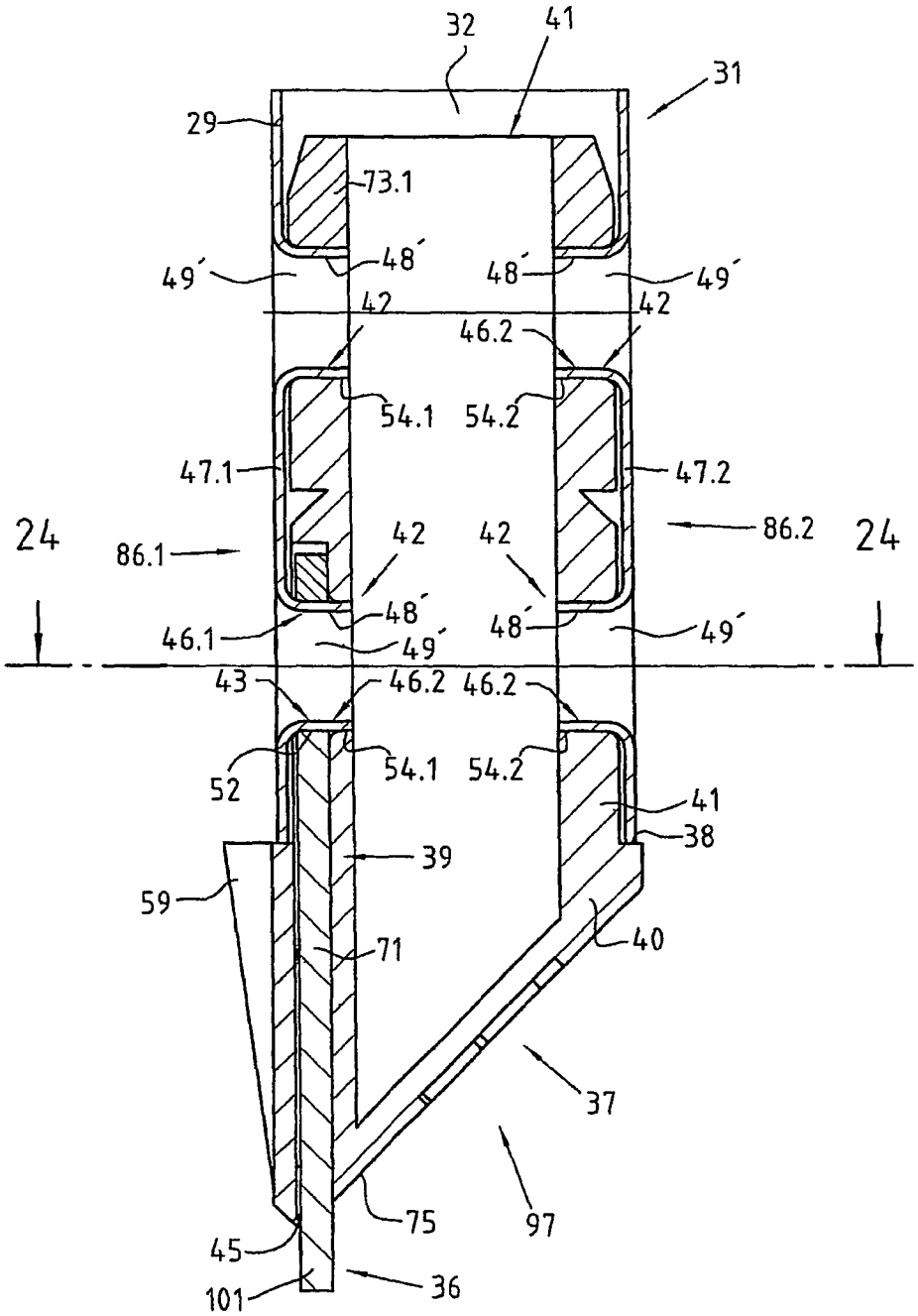
Figure 24:
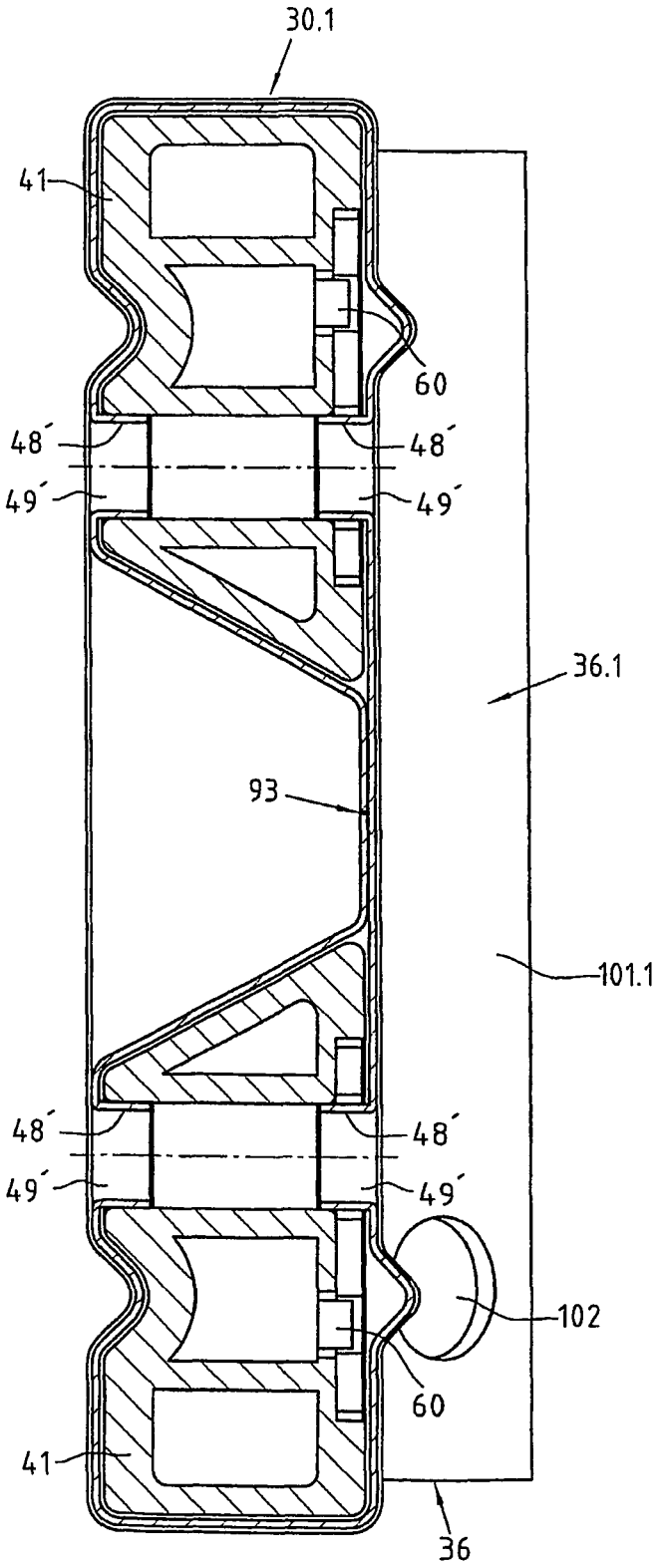
Figure 25:
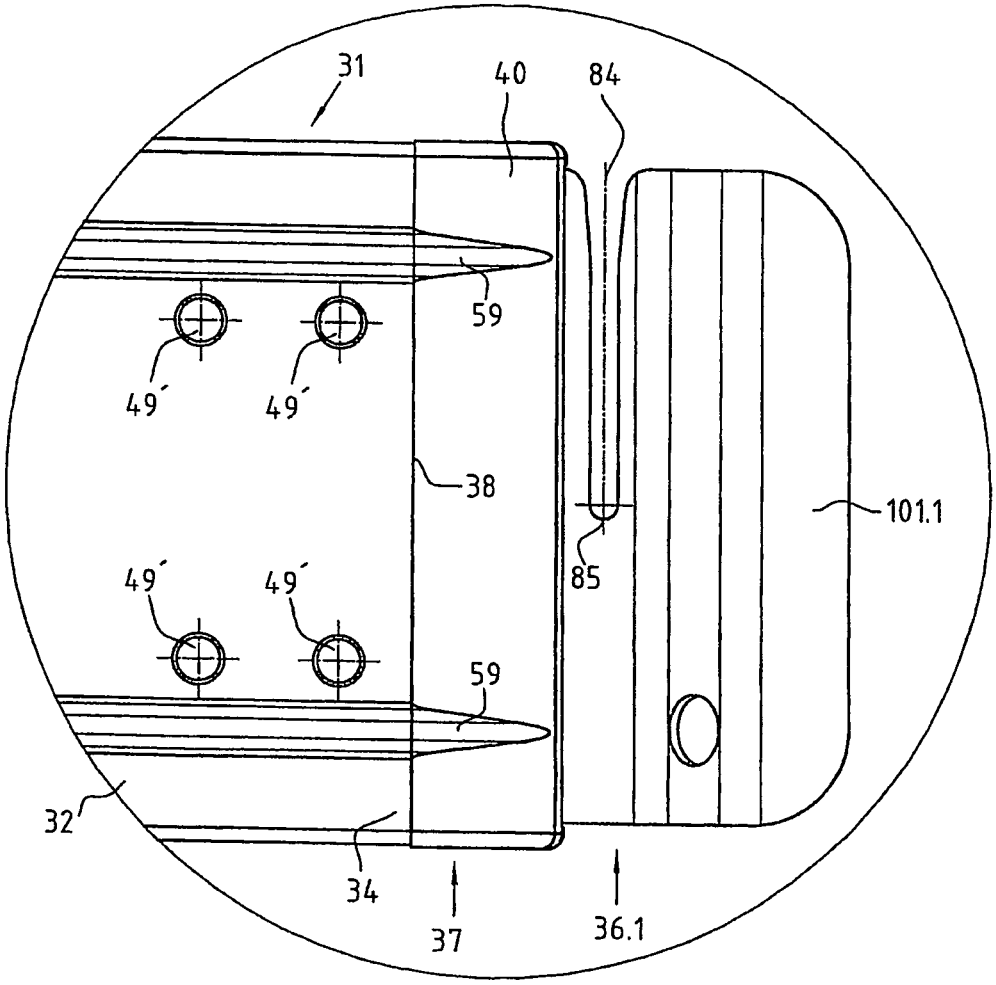
Figure 26:
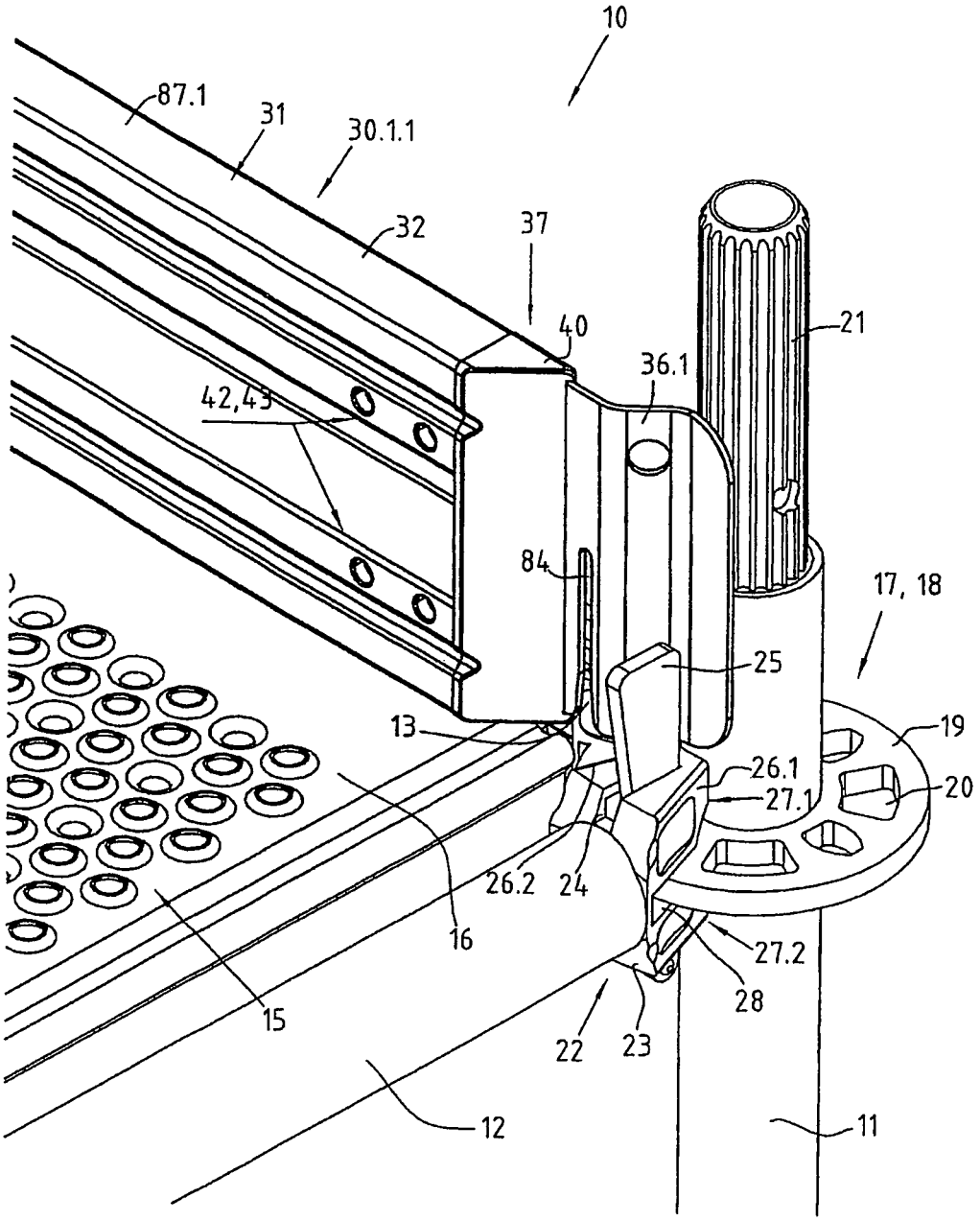
Figure 27:
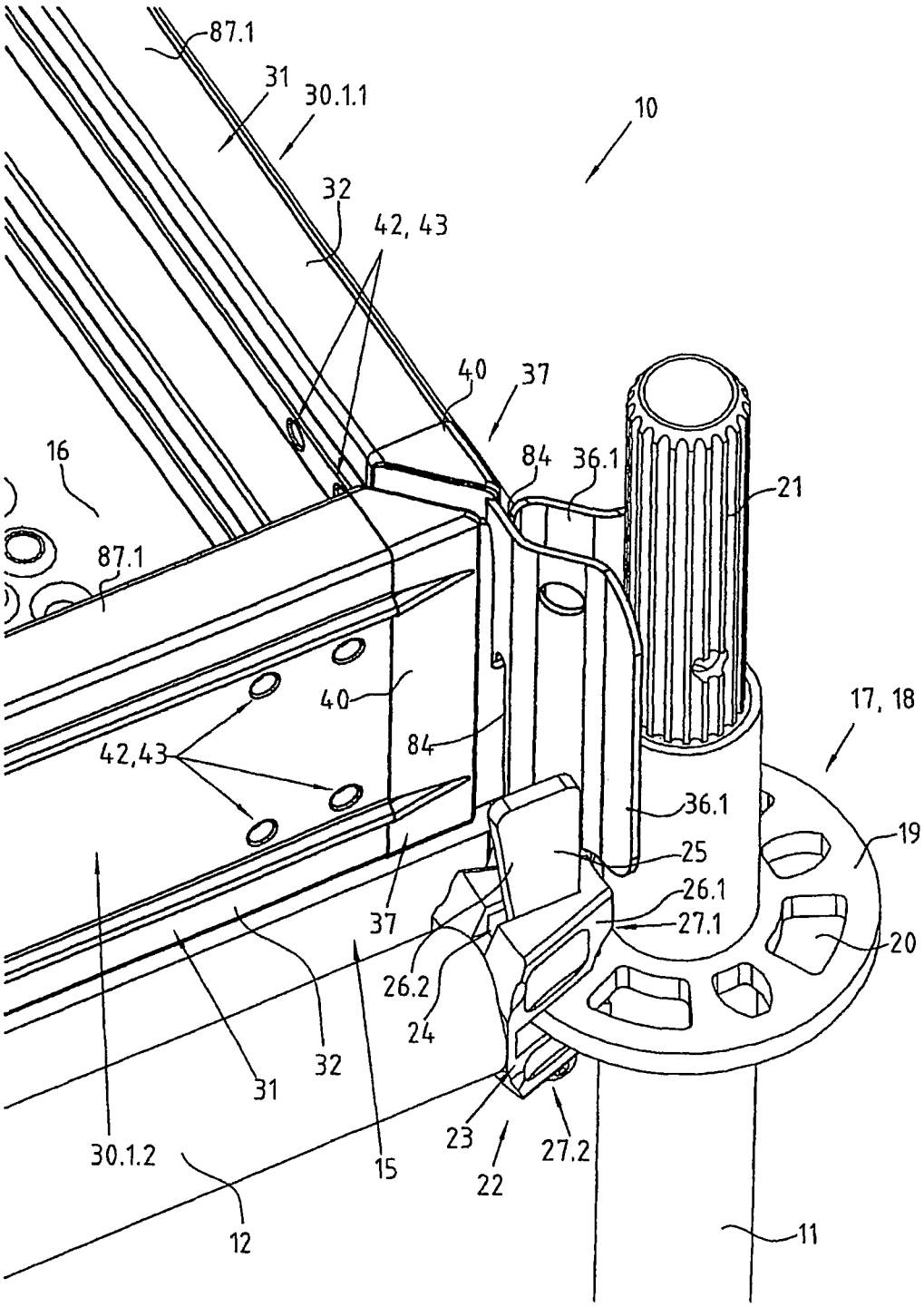
Figure 28:
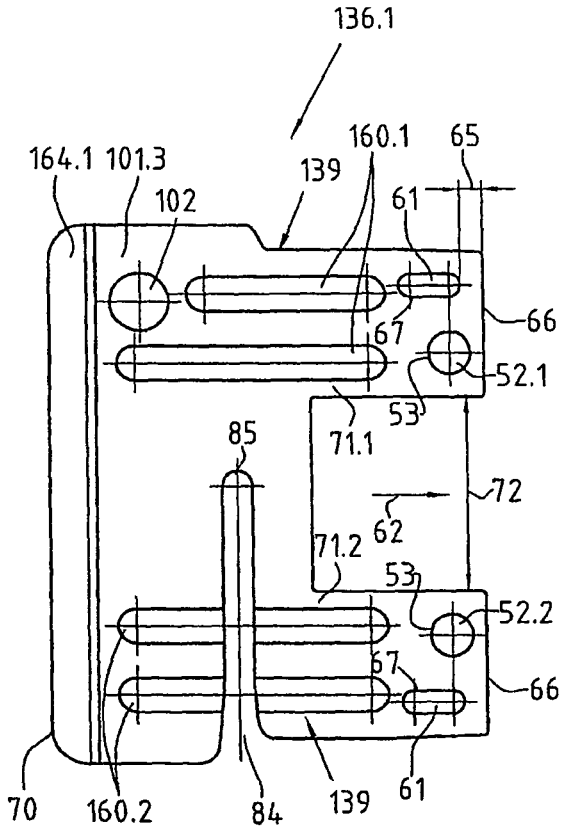
Figure 29:
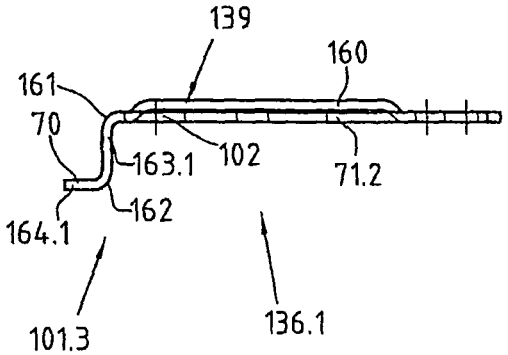
Figure 30:
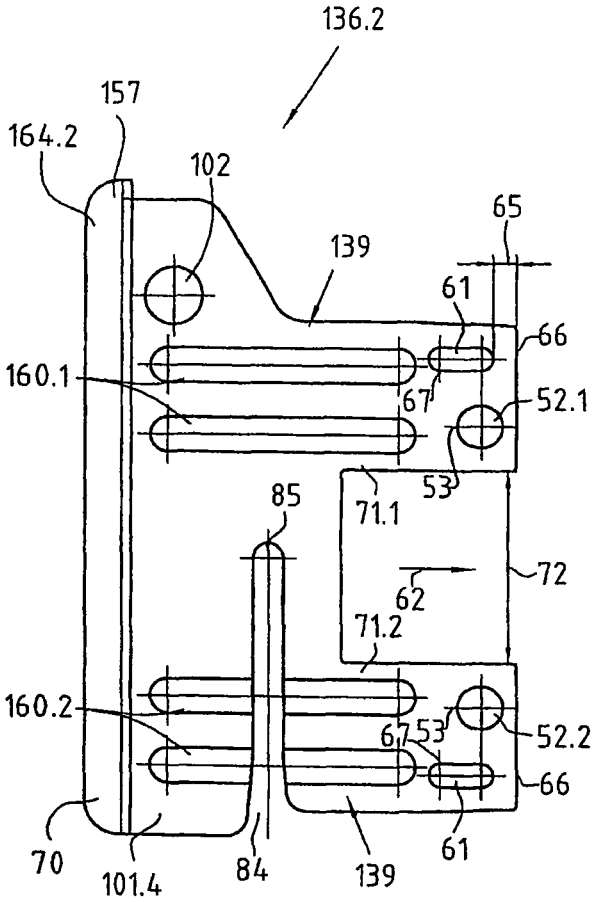
Figure 31:
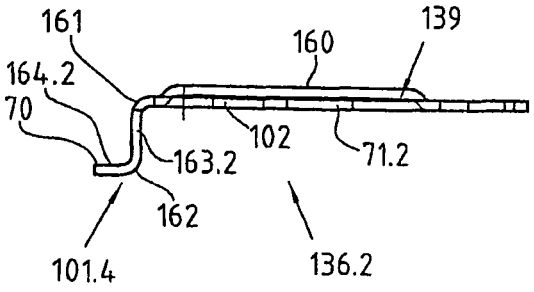
Figure 32:
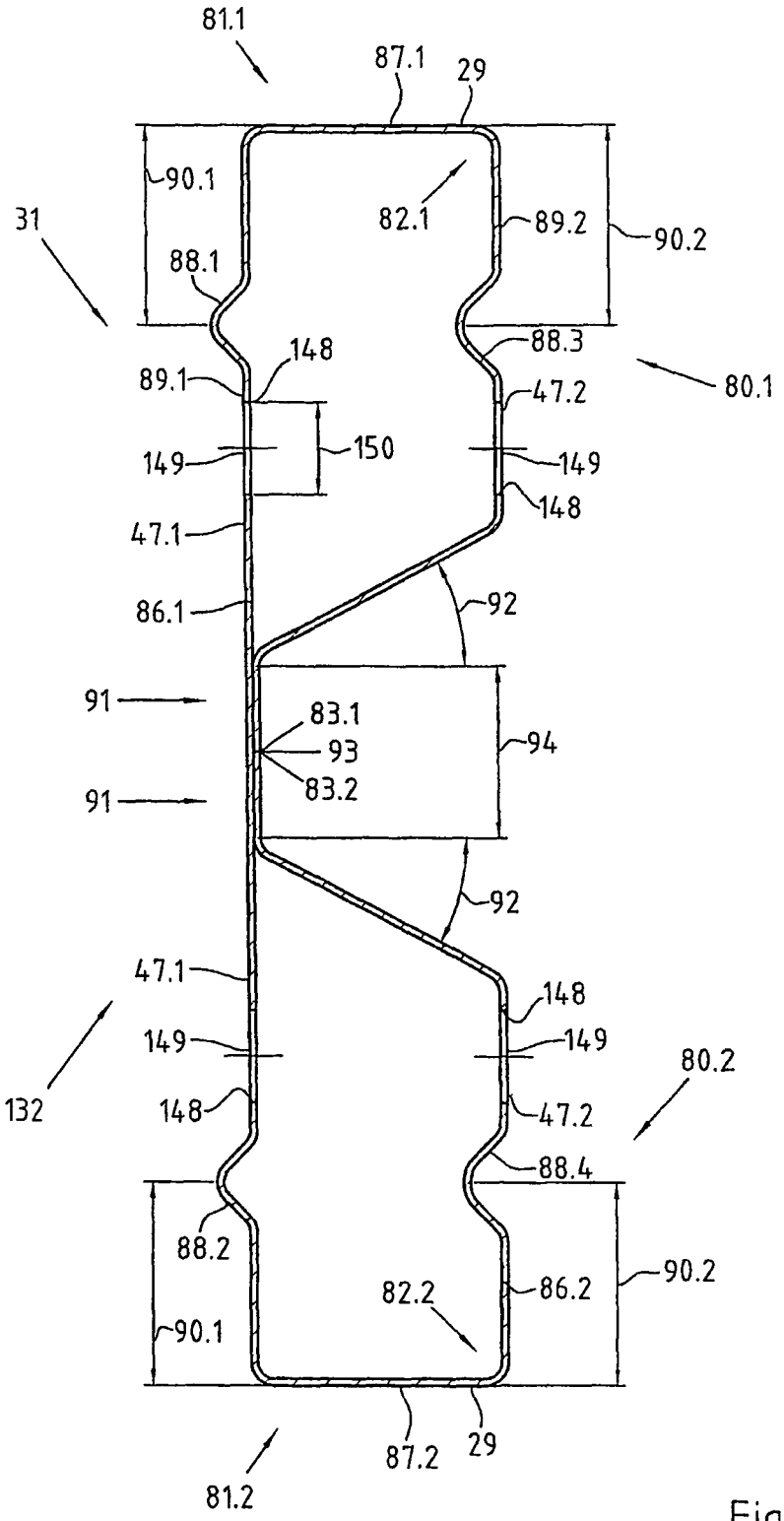
Figure 33:
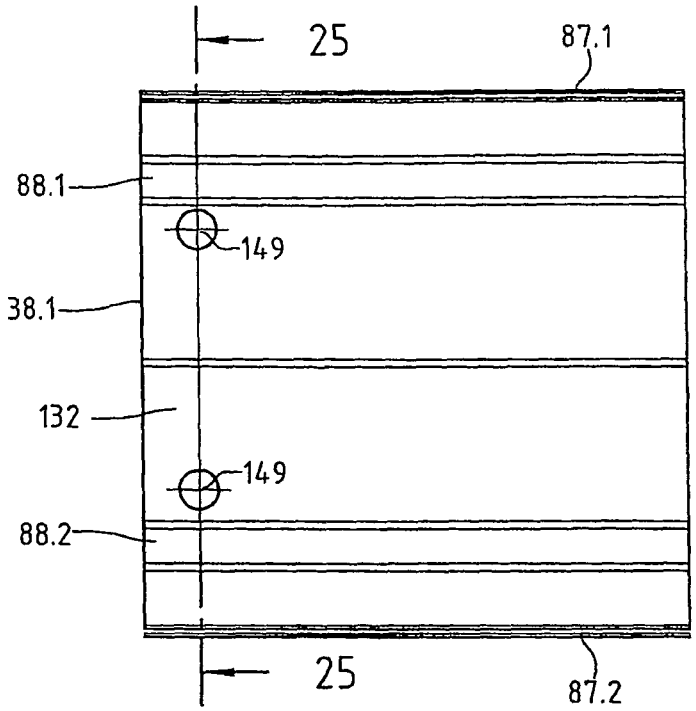
Figure 34:
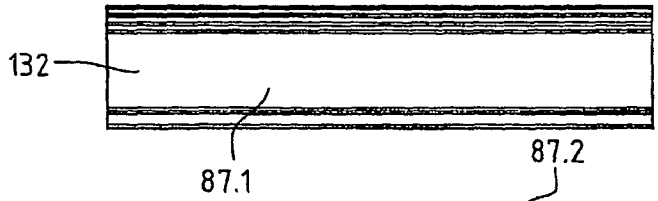
Figure 35:
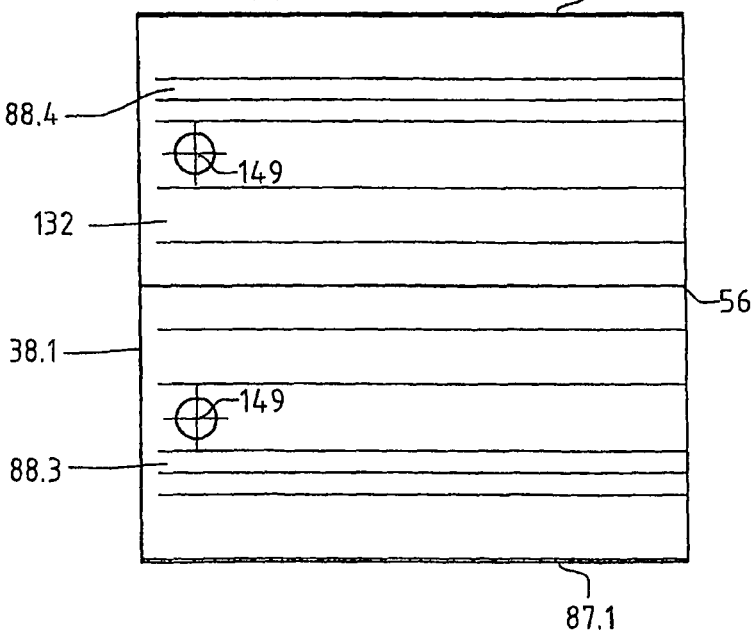
Figure 36:
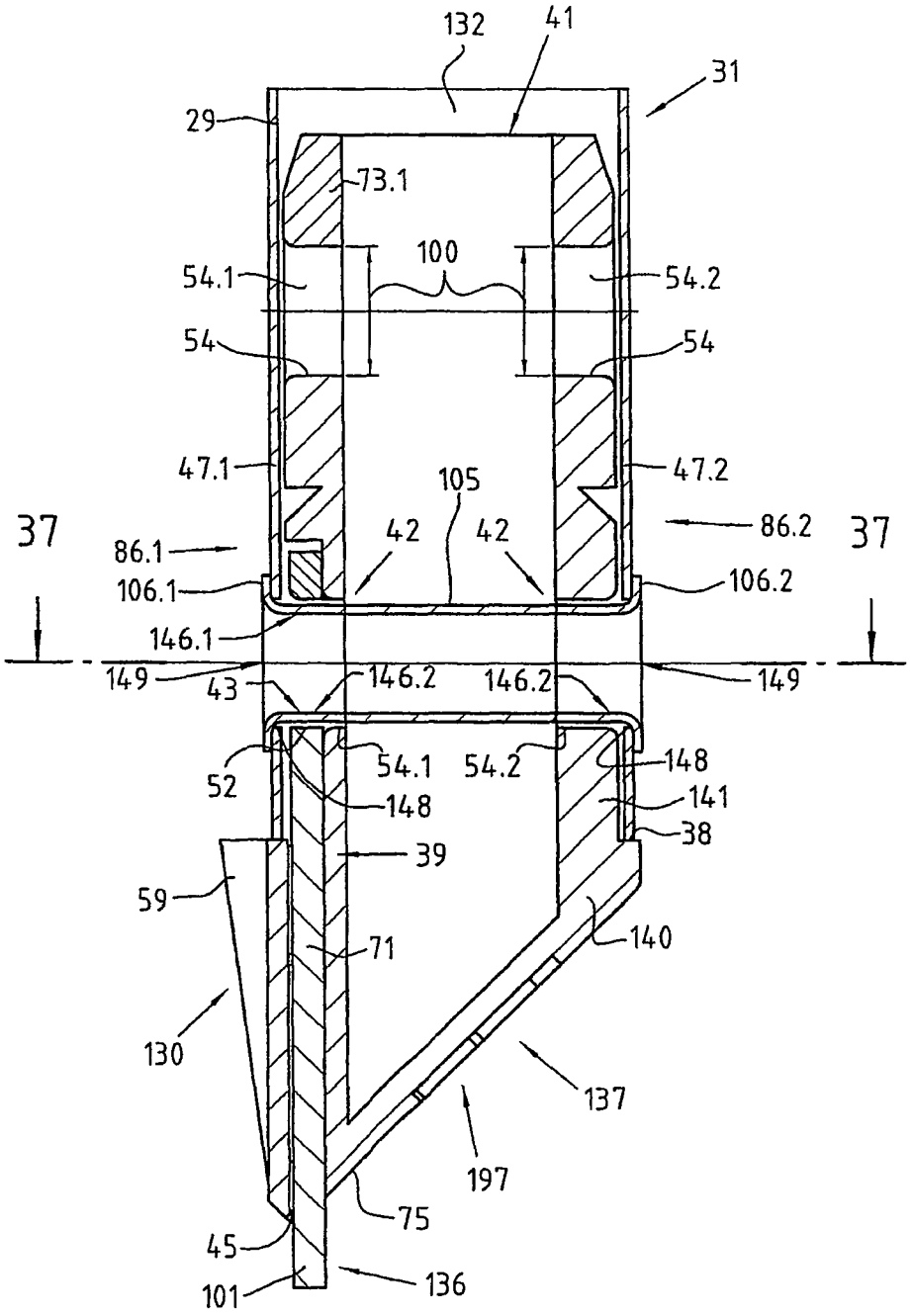
Figure 37:
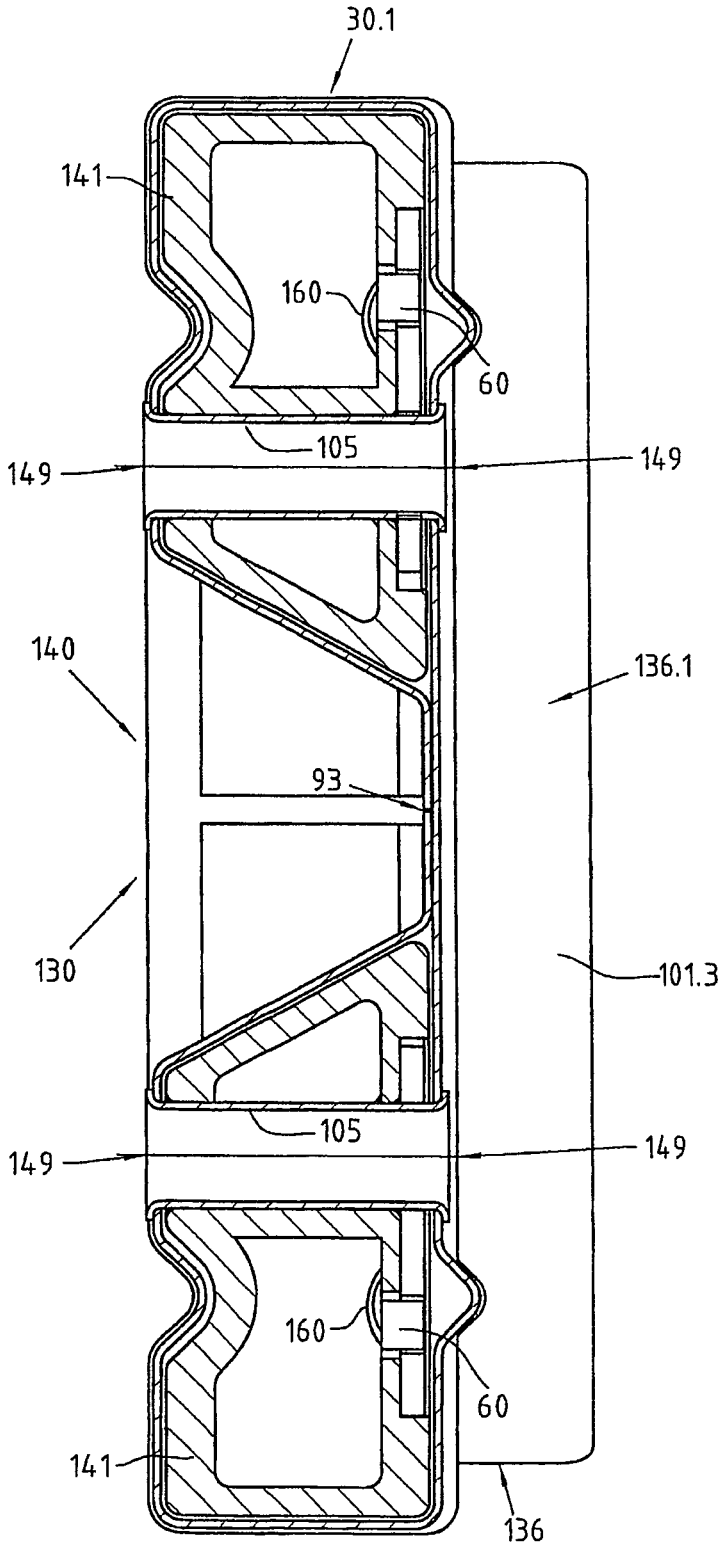
Figure 38:
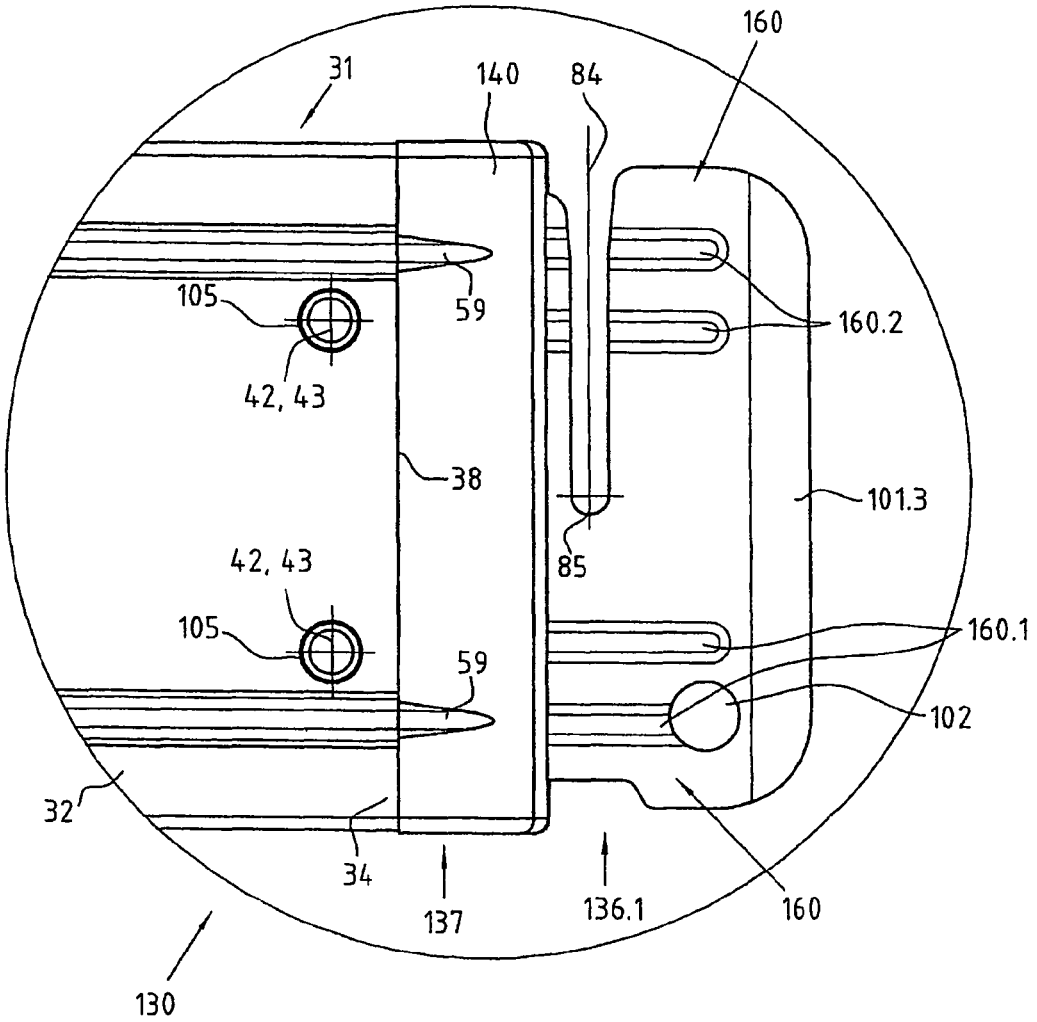
Figure 39:
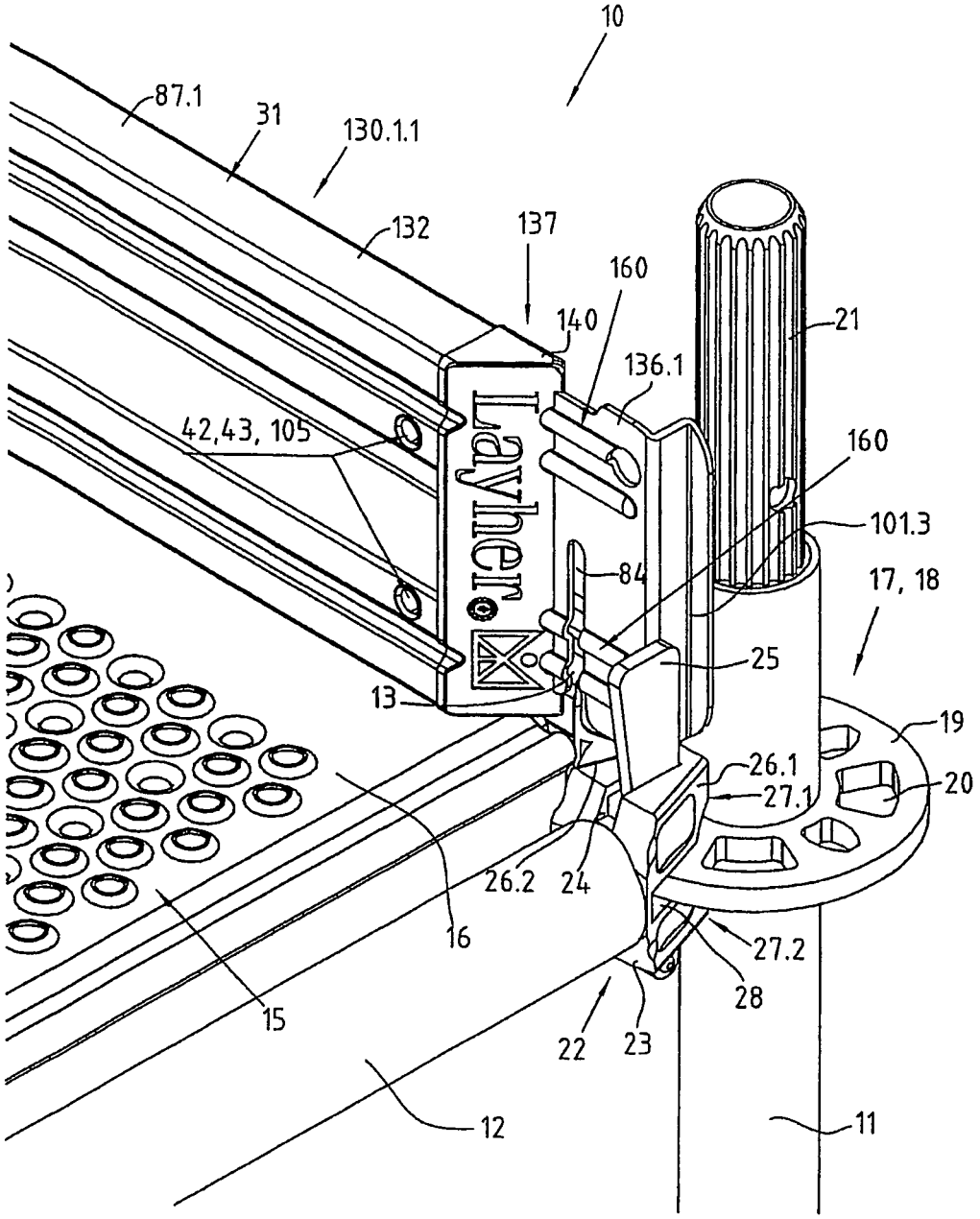
Figure 40:
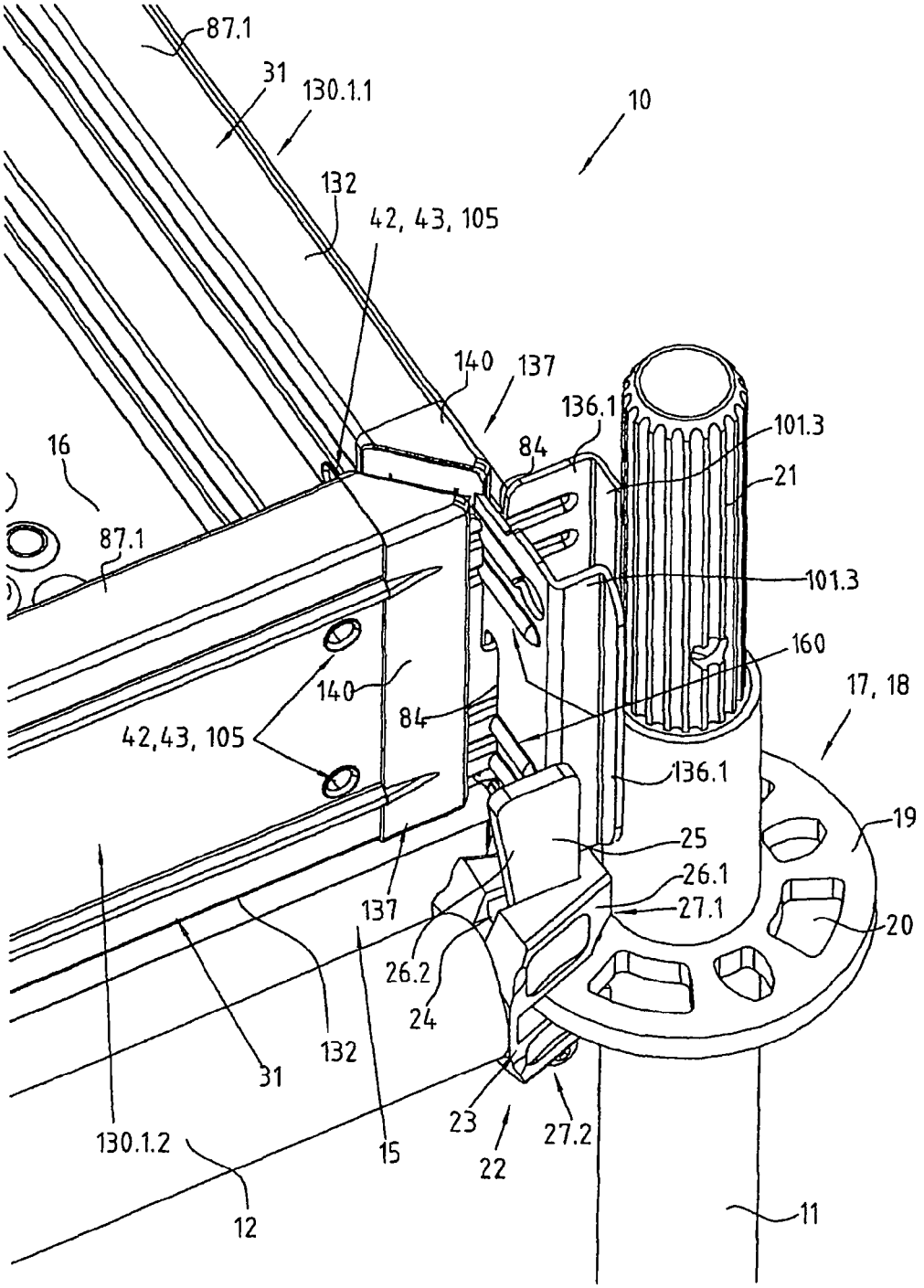

FIG. 22 shows a detail of a toe board according to the invention in the region of one of the ends of the hollow profile of the board unit, with an insertion unit, which is inserted therein and which comprises a fastening body of the end cap and a fastening part of the mounting unit, in a state prior to production of a mechanically positive connection by drawing in the hole edges of the fastening holes, which are provided in the hollow profile, with the help of the schematically illustrated press die;

FIG. 23 shows an illustration, which corresponds with FIG. 22, of the toe board, but now in finally joined state after drawing-in of the hole edges of the fastening holes of the hollow profile, in each instance inwardly and with formation of a mechanically positive connection by engagement behind of the hole edges of the fastening holes, which are provided in the fastening part of the mounting unit, as well as the hole edges of the fastening holes provided in the fastening body of the end cap;

FIG. 24 shows a cross-section of the toe board in a sectional plane shown perpendicularly to that in FIG. 23 and along the section line 24-24;

FIG. 25 shows an enlarged detail in the region of one of the ends of the toe board shown in FIG. 3;

FIG. 26 shows a three-dimensional illustration of a corner region of scaffolding with a mounted transverse toe board, which has a mounting unit according to the first variant of embodiment shown in FIGS. 1 and 3;

FIG. 27 shows the corner region according to FIG. 26 with an additionally used longitudinal toe board, the mounting unit of which is formed similarly in accordance with the variant of embodiment shown in FIGS. 1 and 3;

FIG. 28 shows a plan view of a mounting unit according to a third variant of embodiment;

FIG. 29 shows a longitudinal section of the mounting unit according to FIG. 28;

FIG. 30 shows a view, which corresponds with FIG. 28, of a mounting unit according to a fourth variant of embodiment;

FIG. 31 shows a longitudinal section, which corresponds with FIG. 29, of the mounting unit according to FIG. 30;

FIG. 32 shows a cross-section, which corresponds with FIG. 18, of a board unit with a hollow profile according to an alternative embodiment, which has fastening holes intended for reception of rivets;

FIG. 33 shows a plan view of a detail of the board unit according to FIG. 32 with a view of the wide longitudinal side shown on the left in FIG. 32;

FIG. 34 shows a side view of a detail of the board unit according to FIG. 32 with a view of the narrow longitudinal side shown at the top in FIG. 32;

FIG. 35 shows a side view of a detail of the board unit according to FIG. 32 with a view of the wide longitudinal side shown on the right in FIG. 32;

FIG. 36 shows a cross-section, which extends parallel to the longitudinal axis of the hollow profile shown in FIG. 32, of the board unit, but now in finally assembled state, in which not only a fastening part of a mounting unit, but also a fastening body of an end cap are mechanically positively fastened to the hollow profile with the help of at least one rivet, here by means of two tubular rivets, of which one tubular rivet is illustrated in cross-section and in the joined state;

FIG. 37 shows a cross-section of the toe board in a sectional plane, which is perpendicular to that in FIG. 36, along the section line 37-37;

FIG. 38 shows a detail, which corresponds with the illustration in FIG. 25, of a toe board, with a hollow profile in the alternative embodiment shown in FIGS. 32 to 37, in which the fastening body of the end cap and the fastening limbs of the mounting unit, which is formed in accordance with the variant of embodiment shown in FIGS. 28 and 29, are fastened to the hollow profile by means of tubular rivets;

FIG. 39 shows a three-dimensional illustration of a corner region of a scaffolding with a mounted transverse toe board comprising a mounting unit which is formed in accordance with the variant of embodiment shown in FIGS. 28 and 29 and which is fastened to the hollow profile by means of tubular rivets; and FIG. 40 shows the corner region according to FIG. 39 with an additionally used longitudinal toe board, the mounting unit of which is formed similarly in accordance with the variant of embodiment shown in FIGS. 28 and 29 and which is similarly fastened to the hollow profile by means of tubular rivets.

The toe boards 30; 30.1; 30.1.1, 30.1.2; 30.2; 130; 130.1.1, 130.1.2 shown in the figures serve for lateral enclosing of walk and/or work surfaces 16 of scaffolding floors or scaffolding platforms 15 of a scaffolding 10 (FIGS. 26 and 27 as well as 39 and 40).

Each toe board 30; 30.1; 30.1.1, 30.1.2; 30.2; 130; 130.1.1, 130.1.2 consists of an elongate board unit 31 which here is formed from a hollow profile 32; 132 of preferably galvanised steel plate 29. The longitudinal views thereof are illustrated in, in particular, FIGS. 1 to 5, 19 to 21 and 33 to 35 and the cross-sections thereof are shown in FIGS. 18 and 24 as well as 32 and 37.

The hollow profile 32; 132 is closed at each of its ends 34.1, 34.2, which face away from one another in longitudinal direction 33, with the help of respective closure means 35 formed as an end cap 37; 137. Each board unit 31 has a mounting unit 36; 36.1, 36.2; 136, 136.1, 136.2 which projects in longitudinal direction 33 beyond the respective end 34.1, 34.2 thereof and here consists of sheet steel 70 and which is intended for production of a connection with the scaffolding 10 and/or with an adjacent toe board 30, 130.

Each end cap 37; 137 has a cover part 40; 140 which projects beyond the associated end 34.1, 34.2 of the hollow profile 32; 132 and covers the end edges 38.1, 38.2 thereof and which is composed substantially of plastics material. The end caps 37; 137 further comprise a fastening body 41; 141, which here is connected as one part and integrally with the cover part 40; 140 and which is inserted into the hollow profile 32; 132 of the board unit 31 and here is fixedly connected not only with this, but also with the cover unit 36; 36.1, 36.2; 136, 136.1, 136.2 with the help of fastening means 42. In addition, the mounting unit 36; 36.1, 36.2; 136, 136.1, 136.2 comprises a fastening part 39, 139 which is inserted into the hollow profile 32; 132 and which is firmly connected with the hollow profile 32; 132 of the board unit 31 with the help of a fastening means 43. In the illustrated exemplifying embodiments the entire end cap 37; 137 consists of plastics material, so that not only the cover part 40; 140, but also the fastening body 41; 141 consist of plastics material. The end cap 37; 137 preferably is composed of a thermoplastic plastics material, for example polypropylene, which can be optionally filled with or reinforced by filling and/or reinforcing materials, particularly reinforcing fibers such as glass fibers.

Figure 7:
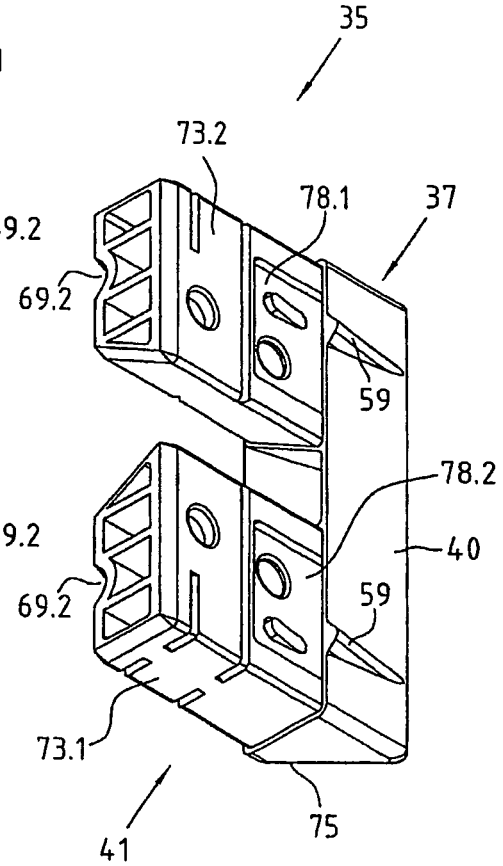
FIG. 7 shows a three-dimensional view of the end cap according to FIG. 6 in a viewing direction obliquely from behind onto the fastening body thereof formed by two insertion bodies spaced apart in transverse direction.
Figure 8:
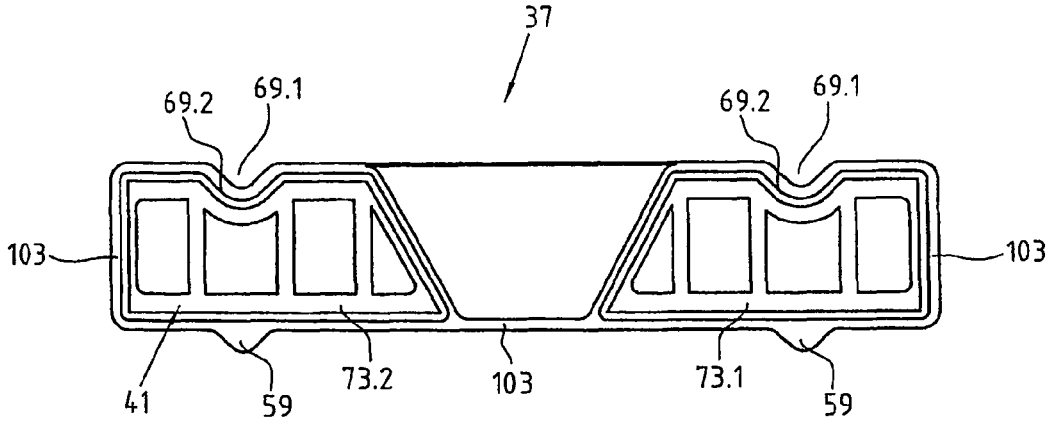
FIG. 8 shows a rear view of the end cap according to FIG. 6.
Figure 9:
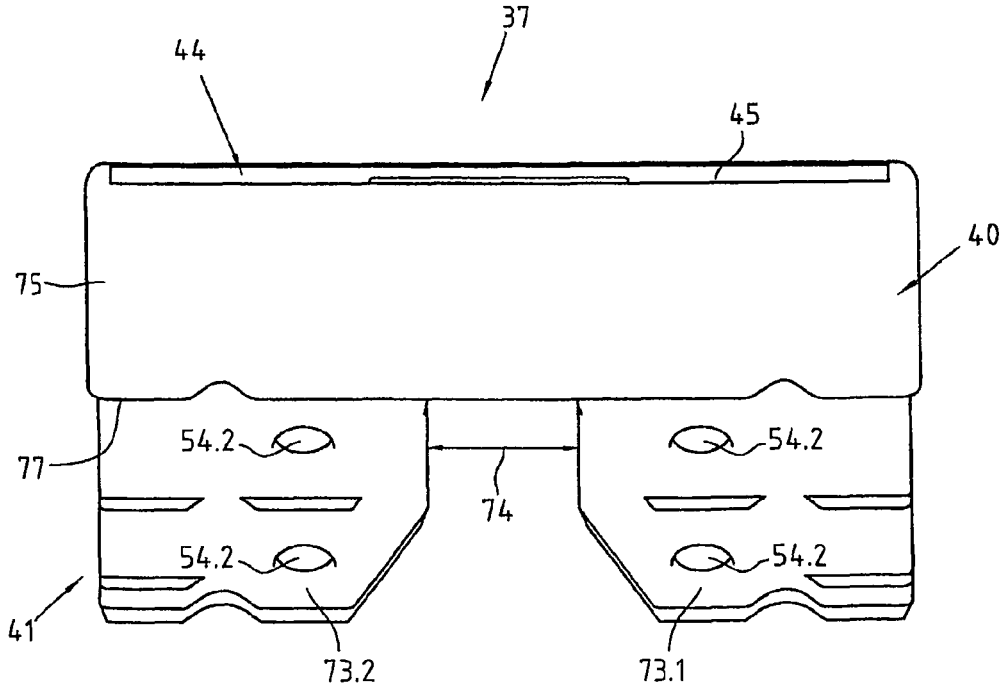
FIG. 9 shows a side view of the end cap according to FIG. 6.
Figure 10:
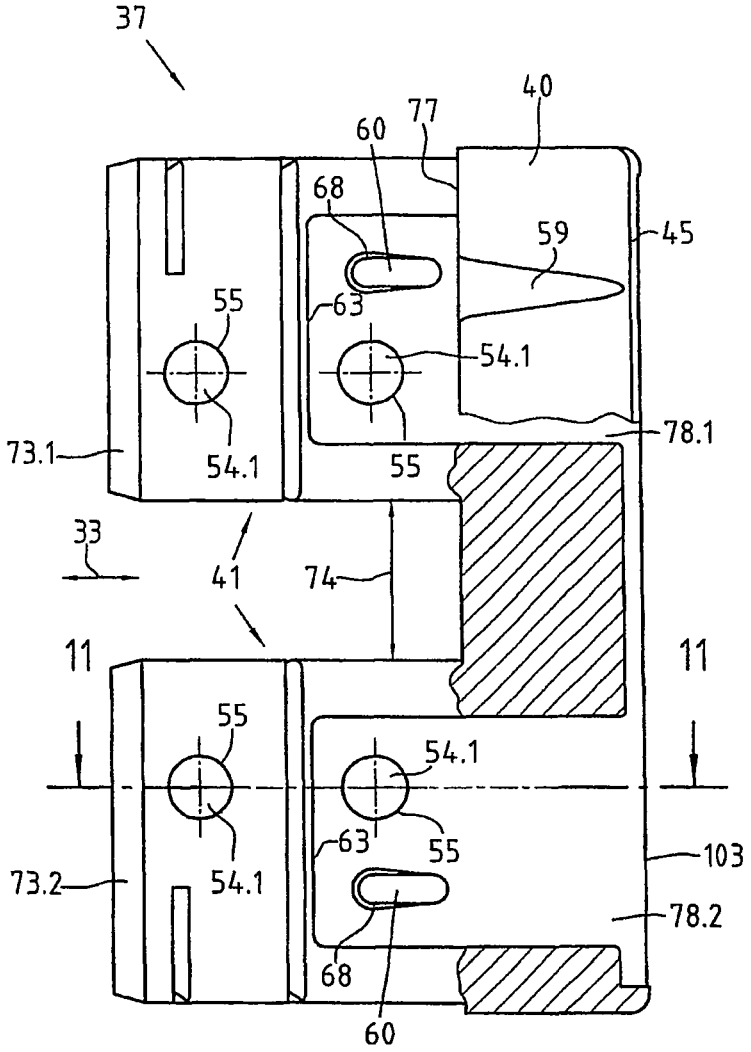
FIG. 10 shows a side view with a part section of the end cap according to FIG. 7.
Figure 11:
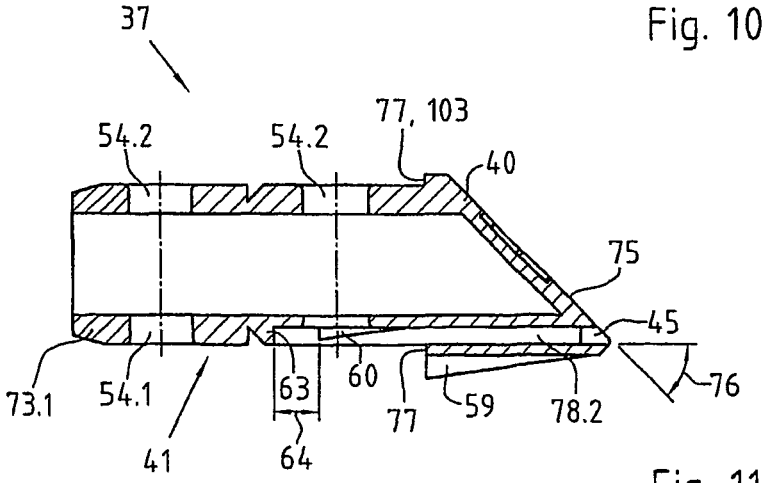
FIG. 11 shows a longitudinal section of the end cap along the section 11-11 in FIG. 10.
Figure 12:
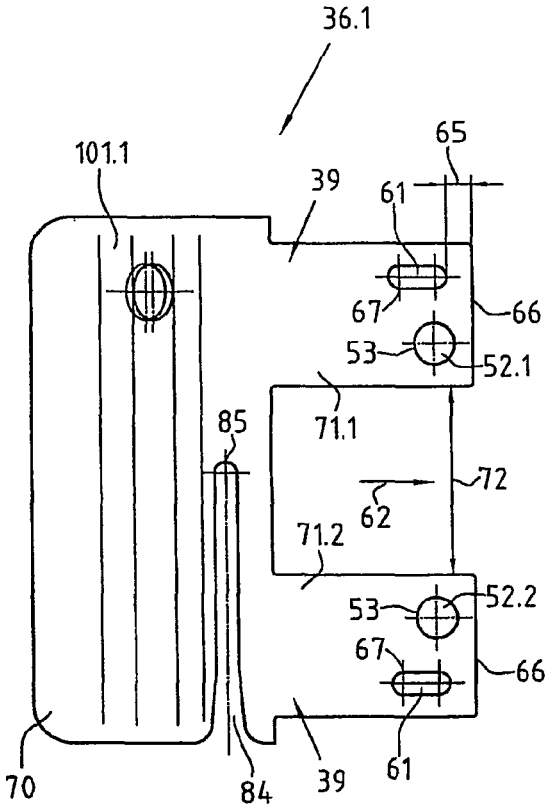
FIG. 12 shows a plan view of a mounting unit according to the first variant of embodiment, which is shown in FIGS. 1 and 3, with a fastening part here arranged parallel to the plane of the sheet.
Figure 14:
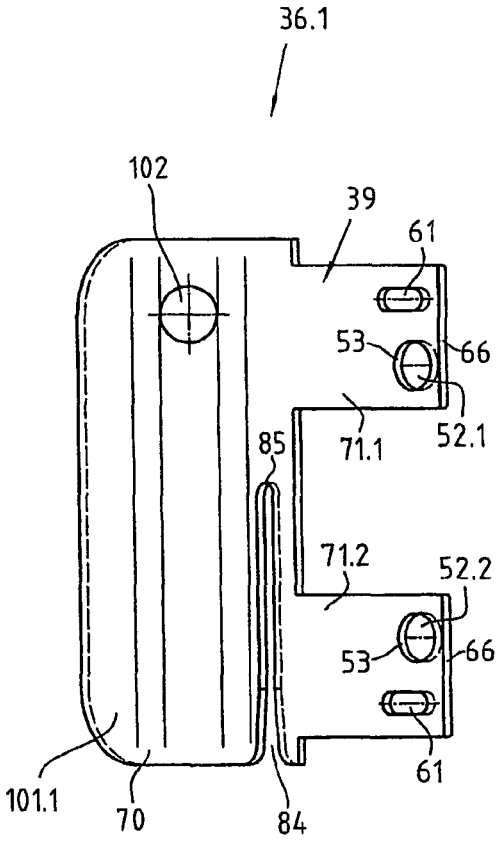
FIG. 14 shows a plan view of the mounting unit according to FIG. 12, with a transition wall part which has a circularly cylindrical hole for introduction of a hook and which is here arranged parallel to the plane of the sheet.

The form of the end caps 37, according to a first exemplifying embodiment, in a state of still not yet mounted at the board unit 31 is evident from FIGS. 6 to 11. The cover part 40 of the end caps 37 has a recess 44 in the form of a slot 45 which here is closed at the full circumference and which in the mounted state extends perpendicularly to the length direction 33 or to the longitudinal axis 56 of the hollow profile 32. In the finally mounted state of the toe board 30; 30.1; 30.1.1, 30.1.2; 30.2 the fastening part 39 of the mounting unit 36; 36.1, 36.2 is plugged through the slot 45 so that the fastening part 39 of the mounting unit 36; 36.1, 36.2 is then enclosed over the full circumference by the wall parts, which bound the slot 45 of the end cap 37, of the cover part 40. The fastening body 41, which in the mounted state is inserted into the hollow profile 32 of the board unit 31, of the end cap 37 is here formed with two insertion bodies 73.1, 73.2, which are arranged parallel to one another to extend in longitudinal direction 33 at a spacing 74 from one another (see, for example, FIGS. 9 and 10). Each insertion body 73.1, 73.2 is formed as a hollow profile, which is respectively provided with a plurality of cavities, which here are divided from one another by way of vertical wall parts (FIGS. 7 and 8). The insertion bodies 73.1, 73.2 here each have an approximately trapezium-shaped cross-section (FIG. 8).

The outer contour and arrangement of the insertion bodies 73.1 and 73.2 relative to the cover part 40 is selected in such a manner that an annular end edge 103, which serves for covering or concealing the end edges 38; 38.1, 38.2 of the hollow profile 32 of the board unit 31 opposite thereto in the mounted state, remains free. This annular end edge 103 of the cover part 40 at the same time forms an abutment 77 against which the end edges 38; 38.1, 38.2 of the hollow profile 32 can bear in the mounted state (see, for example, FIG. 23).

The horizontal wall parts of each insertion body 73.1, 73.2 are here each provided with four recesses formed as passage holes 54.1, 54.2. These are here each arranged in groups of two recesses 54.1, 54.1 and 54.2, 54.2 parallel to the longitudinal direction 33. In that case a further passage hole 54.2 is associated with each passage hole 54.1, wherein the bore axes of these passage holes 54.1 and 54.2 respectively coincide. The passage holes 54.1 and 54.2 here each have the same internal diameter 100, which is, for example, approximately 11 millimeters (FIG. 22).

Each insertion body 73.1, 73.2 here has a rectangularly bounded receiving cavity 78.1, 78.2 which—starting from a wall part, which here extends perpendicularly to the longitudinal direction 33 and is constructed as an abutment 63—extends in longitudinal direction 33 through the cover part 40 up to the slot 45. These receiving cavities 78.1, 78.2 serve for mechanically positive reception of fastening limbs 71.1 and 71.2, which are formed to fit, of the fastening part 39 of the mounting unit 36; 36.1, 36.2, as are shown in, for example, FIGS. 12, 14 and 15, 17.

Projecting into each receiving cavity 78.1, 78.2 is a projection, which is formed to be wedge-shaped in cross-section, of a resilient detent element 60, which is fixedly—here integrally—connected with the end cap 37 at a front fastening point, but which at its end facing away from this fastening point in direction from the end surface 75 of the end cap 37 is received in resiliently deformable manner in a recess surrounding this end. The function thereof in conjunction with the mounting unit 36; 36.1, 36.2 is explained in more detail in a following part of the text.

The end surface 75 of the end cap 37 is preferably formed to be chamfered at an angle 76, which is preferably approximately 45 degrees. In this manner two toe boards 30.1.1 and 30.1.2 provided with end caps 37 of that kind can be quasi arranged 'at a miter' with uniformly small spacing from one another as, for example, illustrated in FIG. 27.

The cover part 40 of the end cap 37 has on its side, which is connected with the end 103 of the end cap 37 tapering to an acute angle, two partly conical projections 59 extending in longitudinal direction 33. The outer contour of each projection 59, at the height of the annular end edge 103 of the abutment 77 of the cover part 40, corresponds with the outer contour of a longitudinal rib 88.1, 88.2, which adjoins in the mounted state, of the hollow profile 32 of the board unit 31. These longitudinal ribs 88.1, 88.2 are here formed as outwardly curved corrugations. On the side, which faces away from the partly conical projections 59, of the end cap 37 this has at least in the region of each of its insertion bodies 73.1 and 73.2, and here also in the region of its cover part 40, a respective recess 69.1, 69.2 which is circularly or elliptically bounded in cross-section and which extends in longitudinal direction 33. The inner contour of the recesses 69.2 in the insertion bodies 73.1, 73.2 corresponds with the inner contour of longitudinal ribs 88.3, 88.4 of the hollow profile 32 of the board unit 31, which here is formed as inwardly curved corrugations (FIG. 18).

The end caps 137 shown in FIGS. 36 to 40 substantially correspond with the end caps 37, but differ slightly in the form of their fastening bodies 141 and their cover parts 140, as apparent particularly from FIG. 37. Whilst each fastening body 41 is subdivided by means of three longitudinal ribs into four cavities (FIGS. 8 and 24), each fastening body 141 is subdivided by only a single longitudinal rib into two cavities (FIG. 37). Moreover, the cover parts and the fastening bodies 141 of the end caps 137 have recesses for reception of corrugations 160 extending in longitudinal direction, according to alternative exemplifying embodiments of mounting units 136; 136.1, 136.2 shown in FIGS. 28 to 31. Moreover, the coverings 140 of the end caps 137 have in a centre region, at which the two insertion bodies 73.1 and 73.2 laterally adjoin, a T-shaped or I-shaped reinforcing profile as shown in FIG. 37. Apart from these differences, the end caps 137 are of the same design as the end caps 37, so that to this extent reference can be made to the explanations with respect thereto at other places of the description. Accordingly, the same elements of the end caps 137 are provided with or denoted by the same reference numerals as for the end caps 37.

Each mounting unit 36; 356.1, 36.2; 136, 136.1, 136.2 comprises a fixing part 101; 101.1, 101.2; 101.3, 101.4, which in the mounted state protrudes out of the end cap 37; 137, and a fastening part 39; 139 which in the mounted state is plugged through the slot 45 of the end cap 37; 137 into the hollow profile 32; 132 of the board unit 31. The fastening part 39; 139 is here formed with two fastening limbs 71.1, 71.2, which are arranged at a spacing 72 from and parallel to one another and which can be plugged through the slot 45 of the cover part 40; 140 of the end cap 37; 137 into the respective receiving cavity 78.1, 78.2 of the end cap 37; 137.

Each fastening limb 71.1, 71.2 of the mounting units 36; 36.1, 36.2; 136, 136.2, 136.2 has at least one recess 52.1, 52.2, which serves for fastening thereof to the hollow profile 32; 132 of the board unit 31 and which here is formed as a respective passage hole. In addition, it can be provided that each fastening limb 71.1, 71.2 is formed with at least one recess 61 which serves for fixing thereof relative to the end cap 37; 137 and which in the exemplifying embodiment is similarly formed as a passage opening and, in particular, preferably as a slot. The inner contour 67 of the recess 61 approximately corresponds with the outer contour 68 of the associated detent element 60 of the end cap 37; 137, so that the respective detent element 60 can in the course of insertion of the respective mounting unit 36; 36.1, 36.2; 136, 136.1, 136.2 in the end cap 37; 137 resiliently detent in the respective recess 61 of the mounting units 36; 36.1, 36.2; 136, 136.1, 136.2.

The recesses 52.1 and 52.2, which are formed as passage holes, of the fastening limbs 71.1, 71.2 of the mounting units 36; 36.1, 36.2; 136, 136.1, 136.2 have a diameter 92 which here corresponds with the diameter 100 of the recesses 54.1 and 54.2, which are similarly formed as passage holes, of the insertion bodies 73.1, 73.2 of the fastening body 41; 141 of the end cap 37; 137. In the illustrated exemplifying embodiments the diameter 99 of the recesses 52.1, 52.2 serving for fastening of the mounting units 36; 36.1, 36.2; 136, 136.1, 136.2 to the hollow profile 32; 132 is approximately 11 millimeters and the diameter 100 of the recesses 54.1, 54.2 serving for fastening of the end cap 37; 137 to the hollow profile 32; 132 and to the mounting unit 36; 36.1, 36.2; 136, 136.1, 136.2 is similarly approximately 11 millimeters (FIG. 22).

In the exemplifying embodiment shown in the figures the respective mounting unit 36; 36.1, 36.2; 136, 136.1, 136.2 has in the region (fixing part 101; 101.1, 101.2; 101.3, 101.4) projecting beyond the end cap 37; 137 a slot 84, which extends substantially perpendicularly to the longitudinal direction 33 of the fastening limbs 71.1, 71.2 and in the mounted state substantially perpendicularly to the longitudinal axis 56 of the hollow profile 32; 132 of the board unit 31 and is open towards one of the narrow longitudinal end faces 87.2 of the board unit extending in longitudinal direction 33 and the slot base 85 of which is preferably arranged approximately at half the height of the board unit 31. In this manner two toe boards 30.1.1 and 30.1.2 or 130.1.1 and 130.1.2 can be advantageously arranged, for example as shown in FIGS. 27 and 40, and also fixed or fastened to one another in that a first mounting unit 36; 136, for example the mounting unit 36.1; 136.1 of the toe board 30.1.1; 130.1.1, is plugged on in the slot 84 of a mounting unit 36; 136 of a second toe board 30, for example of a mounting unit 36.1; 136.2 of a second toe board 30.1.2; 130.1.2. As shown in FIGS. 27 and 40, the slot 84 of the mounting unit 36.1; 136.1 of the first-mentioned toe board 30.1.1; 130.1.1 can, in the plugged-on state, be plugged onto the mounting unit 36.1; 136.1 of the second toe board 30.1.2; 130.1.2. In the state of being plugged onto one another the two narrow longitudinal end faces 87.1 or longitudinal edges of the two toe boards 30.1.1 or 130.1.1 and 30.1.2 or 130.1.2 then consequently lie by the upper edges thereof at the same height level.

Figure 13:
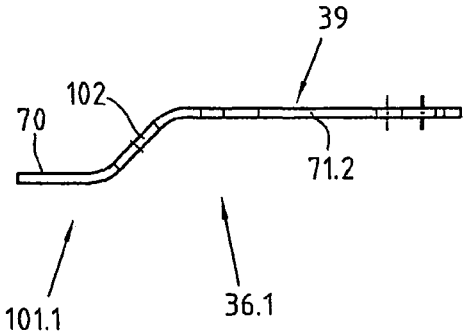
FIG. 13 shows a longitudinal section of the mounting unit according to FIG. 12.

The mounting units 36; 36.1, 36.2; 136, 136.1, 136.2 preferably consist of sheet steel 70. Its respective fixing part 101; 101.1, 101.2; 101.3, 101.4 can be formed with a continuous hole 102 into which a suspension hook, which is not shown in the figures, is introducible. It will be obvious that, in particular, the form of the fixing part, which projects out of the end cap 37; 137, of the mounting unit can also be designed differently from that shown in the figures depending on user and use requirements. For example, the fixing part can also be formed to be the same as or similar to that described and shown in, for example, DE 100 61 506 A1, the disclosure content of which is here included to full extent. The mounting units 36; 136, which preferably consist of sheet steel 70, are cranked transversely to the longitudinal direction 33 in their region projecting beyond the end 34.1, 34.2 of the hollow profile 32; 132, particularly in their region projecting beyond the respective end cap 37; 137. The mounting units 36; 136 preferably consist of a steel plate 70 bent over at least twice (cf. in particular, FIGS. 13 and 16 as well as 29 and 31).

Figure 2:
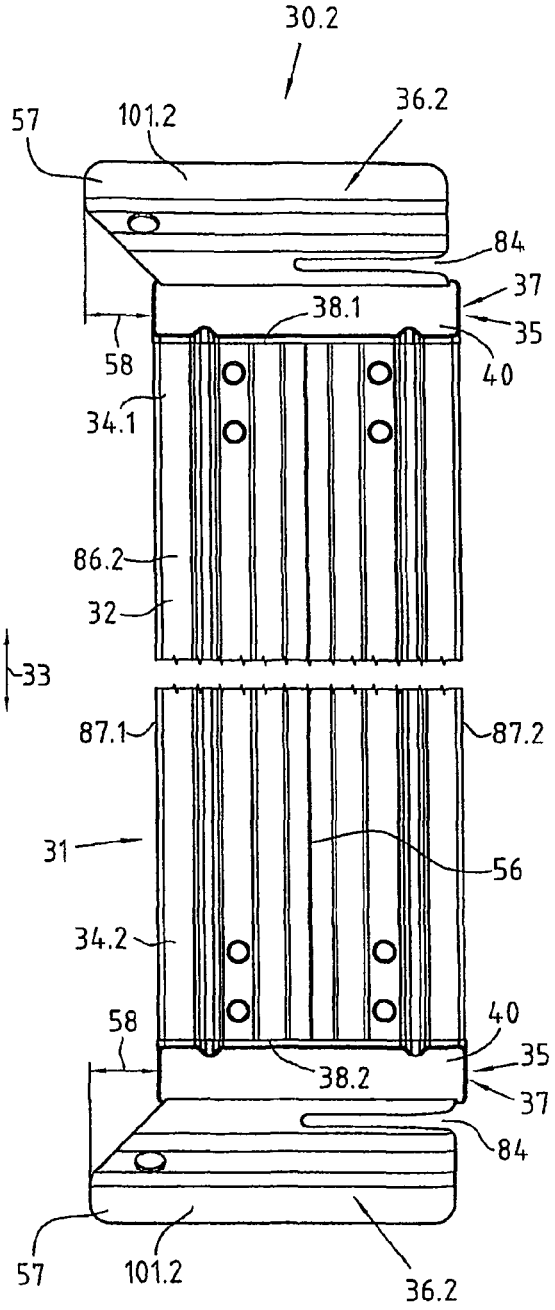
FIG. 2 shows a side view of a toe board with a view of one of the wide longitudinal sides thereof, with a mounting unit according to a second variant of embodiment.
Figure 4:
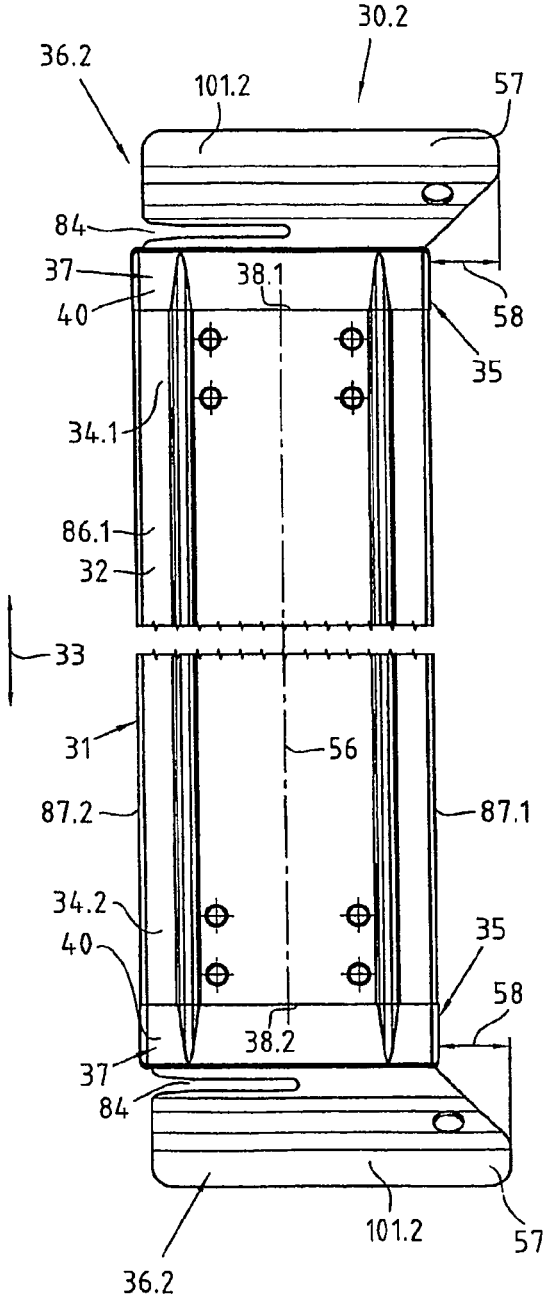
FIG. 4 shows a side view of the toe board according to FIG. 2 with a view of the other wide longitudinal side thereof.
Figure 5:
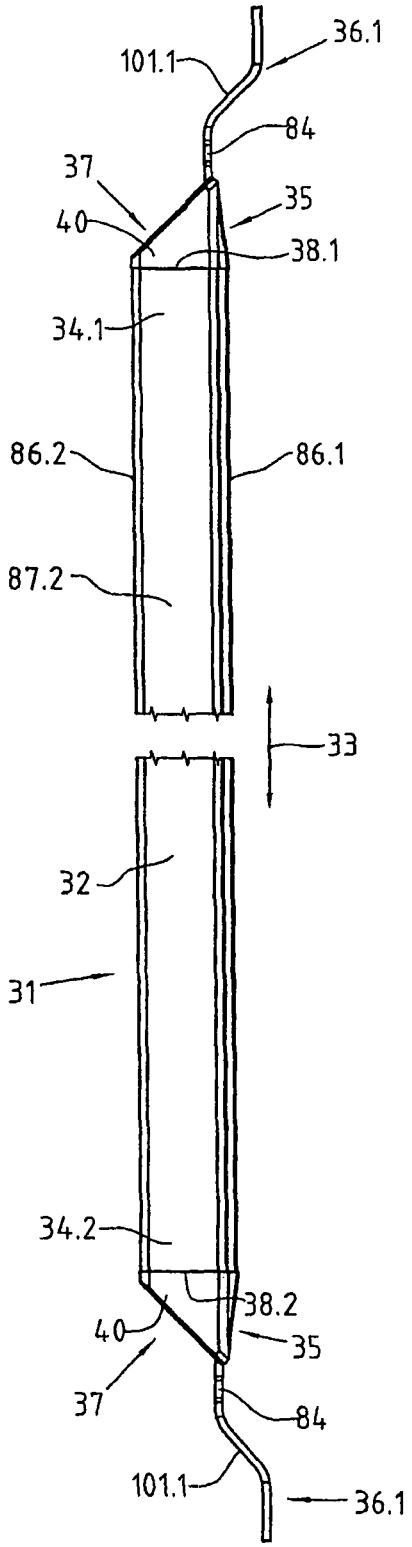
FIG. 5 shows a plan view of the toe board according to FIG. 1 with a view of the narrow longitudinal side, which is shown on the right in FIG. 1, of the toe board, wherein the corresponding plan view of the toe board according to FIG. 2 is identical.
Figure 6:
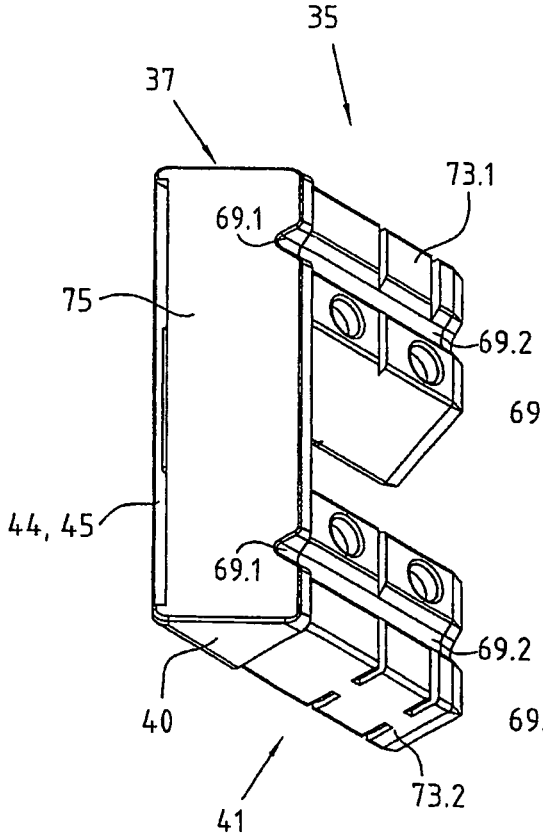
FIG. 6 shows a three-dimensional view of an end cap with the viewing direction obliquely from the front onto the end face of the cover part thereof.
Figure 15:
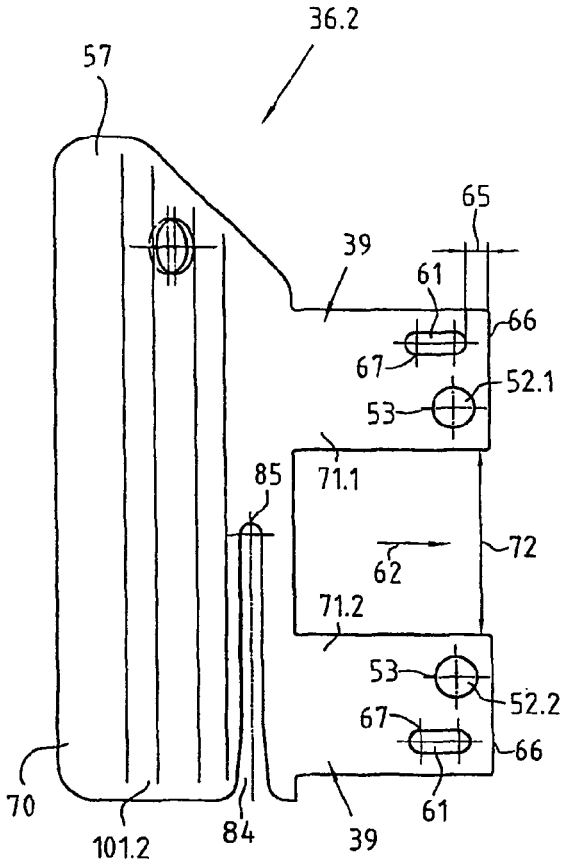
FIG. 15 shows a view, which corresponds with FIG. 12, of a mounting unit according to the second variant of the embodiment shown in FIGS. 2 and 4.
Figure 17:
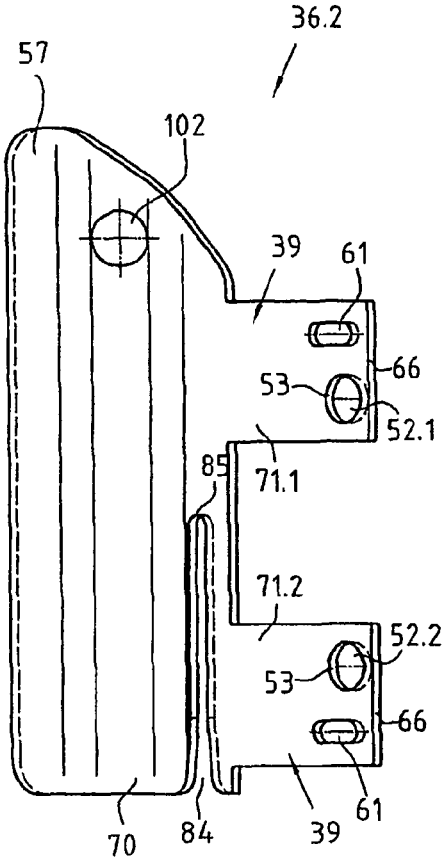
FIG. 17 shows a plan view, which corresponds with FIG. 14, of the mounting unit according to FIG. 15.
Figure 16:
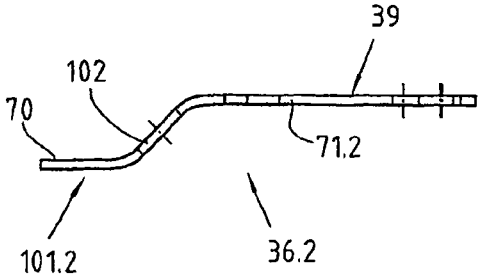
FIG. 16 shows a longitudinal section, which corresponds with FIG. 13, of the mounting unit according to FIG. 15.

The significant difference between the mounting unit 36.1 or 136.1 shown in, in particular, FIGS. 12 to 14 or 28 and 29 and the mounting unit 36.2 shown in, in particular, FIGS. 15 to 17 or the mounting unit 136.2 shown in, in particular FIGS. 30 and 31 consists in that the fixing part 101.2 or 101.4 of the mounting unit 36.2 or 136.2 has a protrusion unit 57 or 157 which in the mounted state of the mounting unit 36.2 or 136.2 at the board unit 31 projects out by a spacing or a protrusion 58 beyond one of the narrow longitudinal end faces 87.1 (FIGS. 2 and 4). With respect to the construction of that kind and the advantages thereof reference can be made at this point to, for the sake of simplicity, DE 202 02 659 U1, the disclosure content of which is included at this point to the full extent.

The variants of embodiment shown in, in particular, FIGS. 28 to 31 of a mounting unit 136; 136.1, 136.2 differ from the variants of embodiment, which are shown in, in particular, FIGS. 12 to 17, of a mounting unit 36; 36.1, 36.2 substantially by the design of the fixing parts 101.3, 101.4 thereof. By contrast to the fixing parts 101.1, 101.2 the fixing parts 101.3, 101.4 are bent over twice at comparatively tight radii, preferably of 1 to 4 millimeters, particularly of approximately 2.5 millimeters, with formation of limbs 163.1 and 164.1 or 163.2 and 164.2 formed at approximately right angles to one another, wherein the respective limb 163.1 or 163.2 is also arranged or bent over approximately perpendicularly to the respective fastening part 139 or the respective fastening limbs 71; 71.1, 71.2 thereof. The respective transversely extending limb 163.1, 163.2 extends, going out from the respective fastening part 139 or from the respective fastening limbs 71; 71.1, 71.2 thereof, away in a first direction. Whereas the fixing parts 101.1 or 101.2 are cranked at an angle of approximately 45 degrees, the fixing parts 101.3 and 101.4 are cranked at an angle of approximately 90 degrees. By virtue of the latter measure it is possible to achieve an enhanced security against longitudinal displacement of a toe board 130 or of several toe boards 130-130 and, in particular, not only in the case of arrangement in a line or in longitudinal direction one behind the other, but also in the case of a corner arrangement in each instance of two toe boards 130-130 as illustrated in, for example, FIG. 40.

In addition, the mounting units 136; 136.1, 136.2 are each provided at the height of the two fastening limbs 71.1 and 71.2 thereof with two respective stiffening corrugations 160; 160.1, 160.2. The corrugations 160; 160.1, 160.2 are here respectively arranged parallel to one another and approximately perpendicularly to the slot 84. In each instance two of the corrugations 160 are associated with one of the fastening limbs 71.1, 71.2. In that case, here the two corrugations 160.1 are associated with the fastening limb 71.1 and the two corrugations 160.2 are associated with the fastening limb 71.2. The corrugations 160; 160.1, 160.2 are constructed and mounted in such a manner that they extend away from the fastening part 139 or from the fastening limbs 71; 71.1, 71.2 thereof in a second direction opposite to the first direction of extension of the limbs 163.1, 163.2. The respective two corrugations 160.1 associated with the respective fastening limb 71.1 extend, going out from the respective fixing parts 101.2, 101.4, continuously up to the respective fastening limb 71.1. By contrast thereto the respective two corrugations 160.2 associated with the respective fastening limb 71.2 are interrupted by the respective slot 84, wherein a first part of the respective corrugation 160.2 extends in the fixing part 101.3, 101.4, whilst a second part of the respective corrugations 160.2 extends from the respective fixing part 101.3, 101.4 up to the respective fastening limb 71.2. In the exemplifying embodiments shown in the figures all corrugations 160; 160.1, 160.2 project, in the finally mounted state, not only into the end cap 137, but also out beyond the cover part 140 thereof (see FIGS. 37, 39 and 40). The corrugations 160; 160.1, 160.2 able to be selectably provided serve for enhanced stiffening of the respective mounting unit 136.

Again, by contrast to the variants of embodiment, which are shown in, in particular, FIGS. 12 to 17, of the mounting units 36; 36.1, 36.2 in the case of the mounting units 136; 136.1, 136.2 the respective hole 102 is disposed in that part of the mounting unit 136; 136.1, 136.2 arranged between the limb 163.1, 163.2 and the fastening limbs 71; 71.1, 71.2. In the illustrated exemplifying embodiments the respective hole 102 is disposed in the region of the front end of the respective corrugation 160.1 arranged at the outermost corrugation 160.1 of the respective two corrugations 160.1 associated with the fastening limb 71.1.

A first exemplifying embodiment of a hollow profile 32, which here consists of galvanised steel plate 29 and to which the fastening body 41 of the end cap 37 and the fastening part 39 of the mounting unit 36; 36.1, 36.2 are fastened with the help of shaped wall parts 47.1, 47.2 of the hollow profile 32, is shown in, in particular, FIGS. 1 to 4 and 18 to 27.

The form of the hollow profile 32 in a state prior to mounting and fastening of the end cap 37 and the mounting unit 36 to the hollow profile 32 is evident from FIGS. 18 to 22. The hollow profile 32 is produced from a blank of steel plate 29 by bending and/or flanging the same, especially in or on a roller profiling train. In that case, the two longitudinal ends 83.1 and 83.2 of the blank of steel plate 29 are advantageously connected together free of separate mechanical fastening means, such as rivets or screws, and also fee of welding methods requiring a separate joining material, here in a butt joint 93, and, in particular, with the help of either a press-joining method, such as, for example, through-joining, clinching and/or roller cutting and stamping, or with the help of a laser welding method. In that case the two longitudinal ends 83.1 and 83.2 of the steel plate blank are preferably connected together and/or with an opposite wall part 47.1 of the hollow profile 32 over the entire or substantially over the entire length of the hollow profile 32. The wall thickness of the hollow profile 32 is preferably less than 2 millimeters, particularly less than 1 millimeter, for example 0.8 millimeters or only 0.6 millimeters.

The hollow profile 32 of the board unit 31 has in the region of each of its ends 34.1, 34.2 a number, here eight, of passage holes 49 which corresponds with the number of recesses or passage holes 54.1, 54.2 in the fastening body 41 of the end cap 37. These passage holes 49 in the hollow profile 32 have, in a state in which the end cap 37 and the mounting unit 36; 36.1, 36.2 are still not yet inserted into the hollow profile 32 and mechanically positively connected therewith, a diameter 50 which is very much smaller than the diameter 99 of the recesses 52.1, 52.2, which are formed as passage openings, in the fastening limbs 71.1, 71.2 of the fastening part 59 of the mounting unit 36; 36.1, 36.2 and accordingly also very much smaller than the diameter 100 of the recesses 54.1, 54.2, which are similarly formed as passage openings, of the insertion bodies 73.1, 73.2 of the end cap 37. The diameter 50 of the passage holes 49 is, in the exemplifying embodiment, approximate 4.5 to 5 millimeters.

The end edges 38.1 and 38.2 of the hollow profile 32 span a plane arranged perpendicularly to the length direction 33 or perpendicularly to the longitudinal axis 56 of the hollow profile 32. The hollow profile 32 is formed in the illustrated exemplifying embodiment with two cross-sectionally closed longitudinal beams 80.1 and 80.2, which are both constructed as edge beams 81.1 and 81.2 and extend over the entire length of the board unit 31. The longitudinal beams 80.1 and 80.2 have a box shaped, here trapezium-shaped, cross-section 82.1, 82.2 in a section perpendicular to the longitudinal axis thereof or perpendicularly to the longitudinal axis of the board unit 31. In that case the wall parts, which are arranged oppositely at a spacing and which go out from a double wall region 91 having a width 94, of the longitudinal beams 80.1 and 80.2 are respectively arranged at an angle 92 relative to a normal to a wall part 47.1 of a first wide longitudinal side 86.1 of the board unit 31 (FIG. 18).

Each of the longitudinal beams 80.1, 80.2 designed as edge beams 81.1, 81.2 has on sides, which face away from one another and form a wall part of the wide longitudinal sides 86.1, 86.2 of the board unit 31 facing away from one another, longitudinal ribs 88.1, 88.2; 88.3, 88.4 extending over its entire or substantially its entire length and formed as corrugations. The longitudinal ribs 88.1 and 88.2 arranged on the first wide longitudinal side 86.1 respectively extend upwardly of the outer boundary surfaces 89.1 of the first wide longitudinal side 86.1 of the board unit 31 and the second longitudinal ribs 88.3, 88.4 arranged on the second wide longitudinal side 86.2 extend downwardly of the outer boundary surface 89.2 of the second wide longitudinal side 86.2, which faces away from the first wide longitudinal side 86.1, of the board unit 31. These second longitudinal ribs 88.3 and 88.4 thus each extend in the cavities of the respective longitudinal beam 80.1, 80.2. The longitudinal ribs 88.1 and 88.3 of the longitudinal beam 80.1 each have from the first narrow longitudinal end face 87.1 of the board unit 31 a spacing 90.1 or 90.2 which here is of the same size. In addition, the longitudinal ribs 88.2 and 88.4 of the longitudinal beam 80.2 have from the other narrow longitudinal end face 87.2 of the board unit 31 a spacing 90.1 or 90.2 which here is similarly of the same size. Moreover, here not only the two spacings 90.1, 90.1, but also the two spacings 90.2, 90.2 are respectively of the same size. These spacings 90.1, 90.2 are between 15 and 35 millimeters, preferably between 20 and 30 millimeters and, in the exemplifying embodiment, approximately 24 millimeters. These spacings 90.1, 90.2 of the longitudinal ribs 88.1, 88.2; 88.3, 88.4 from the narrow longitudinal end face 87.1, 87.2, which is respectively associated therewith, of the board unit 31 are selected in such a manner that they enable gripping of the board unit 31 by hand from one of its narrow longitudinal end faces 87.1, 87.2 in such a manner that at least one of the longitudinal ribs 88.1, 88.2 on a first wide longitudinal side 86.1 of the wide longitudinal sides 86.1, 86.2 of the board unit 31 can be gripped behind by at least one first finger of the hand or that at least one first finger of the hand can engage in at least one of the longitudinal ribs 88.3, 88.4 on a first wide longitudinal side 86.2 of the wide longitudinal sides 86.1, 86.2 of the board unit 31, whilst at the same time another finger, preferably the thumb, of the same hand can grip the second wide longitudinal side 86.2 or 86.1, which faces away from the first wide longitudinal side 86.1 or 86.2, of the board unit 31.

Apart from the fact the said longitudinal ribs 88.1, 88.2; 88.3, 88.4 can serve for favourable gripping and handling of the toe board 30; 30.1; 30.1.1, 30.1.2; 30.2, these longitudinal ribs 88.1, 88.2; 88.3, 88.4 can advantageously serve as stiffening and/or stacking ribs. The longitudinal ribs 88.1, 88.2; 88.3, 88.4 are constructed and arranged in such a manner that they enable stacking of several toe boards 30, 30 one above the other with formation of a mechanically positive connection, which hinders or prevents displacement of the toe boards 30, 30 perpendicularly to the respective length direction 33 thereof, of the toe boards 30, 30 stacked one on the other.

The mounting and fastening of the mounting units 36; 36.1, 36.2 and the end caps 37 on and to the hollow profile 32 of the board unit 31 with formation of a toe board 30 according to the invention is described in the following:

In a first step the mounting units 36; 36.1, 36.2 are each connected with a respective end cap 37, wherein the fastening body 41 of the end cap 37 and the fastening part 39 of the mounting unit 36; 36.1, 36.2 each form a respective insertion unit 97. Thus, initially the respective mounting unit 36; 36.1, 36.2 is inserted with its fastening limbs 71.1 and 71.2 foremost in insertion direction 62 (FIGS. 12 and 15) through the slot 45 of the cover part 40 of the end cap 37 into the respectively associated receiving cavity 78.1 or 78.2 of the end cap 37. In that case the free insertion ends of the fastening limbs 71.1 and 71.2 run on the part of the respective detent element 60 extending into the respective receiving cavity 78.1, 78.2 and in the course of continuing insertion of the mounting unit 36; 36.1, 36.2 into the end cap 37 the resilient detent elements 60 are pressed inwardly against the spring forces thereof. In the course of further plugging-on or plugging-in of the fastening part 39 of the mounting unit 36 in insertion direction 62 into the end cap 37 the respective detent element 60 ultimately automatically detents in the respective recess 61 of the fastening limbs 71.1, 71.2 of the fastening part 39 of the mounting unit 36. The plugging or insertion of the fastening part 39 of the mounting unit 36 onto or into the end cap 37 is limited by an abutment 63 (FIGS. 10 and 11), at which the fastening part 39 of the mounting unit 36 can abut during plugging onto or into the end cap 37 so that the mounting unit 36 in the mounted state is disposed in a position relative to the end cap 37 preferably predetermined by the position of the abutment 36. The abutment 63 and the detent element 60 of the end cap 37 are arranged at a spacing 64 which is the same size as or slightly larger than the spacing 65 between the recess 61, which is associated with the detent element 60, of the fastening part 39 of the mounting unit 36 and an end edge 66, which is associated with the abutment 63, of the fastening part 39 of the mounting unit 36 (see FIGS. 11, 12 and 15). It can thereby be achieved that the detent element 60 in the mounted state is detented, with formation of a mechanically positive connection, in the passage opening 61 of the fastening part 39 of the mounting unit 36 in such a manner that the fastening part 39 of the mounting unit 36 mounted on the end cap 37 is secured at least against withdrawal in a direction opposite to the insertion direction 62. In this manner there is initially obtained a unit, which can be handled simply and safely, consisting of the end cap 37 and the mounting unit 36 which is inserted thereinto and which is captively and preferably non-detachably connected with the end cap 37. This unit comprises an insertion unit 97 formed by the fastening part 39 of the mounting unit 36 and the fastening body 41 of the end cap 37.

In a second step the insertion unit 97 can be subsequently inserted into the hollow profile of the board unit 31 as is illustrated by way of example in FIG. 22.

In a third step subsequent thereto the fastening part 39 of the mounting unit 36 and also the fastening body 41 of the end cap 37 are firmly connected with the hollow body 32 and, in particular, free of separate mechanical fastening means, such as rivets or screws, and with formation of a mechanically positive connection 46.1, 46.2. In the illustrated exemplifying embodiment not only the mounting unit 46 and the end cap 37 are connected with the hollow profile with formation of a mechanically positive connection 46.1, 46.2, but also the mounting unit 36 and the end cap 37 are connected together with formation of a mechanically positive connection. Reference is made particularly to FIGS. 23 and 24 with respect thereto.

According to the invention the mechanically positive connection 46.1, 46.2 is achieved by a pressing process producing a local deformation of a wall part 47.1, 47.2 of the hollow profile 32. The deformation can be achieved by drawing in or pressing in a hole edge region 48 of a hole 49 provided in a wall part 47.1, 47.2 of the hollow profile 32, here with the help of press dies 51.1, 51.2, 51.3, 51.4 (FIG. 22), into one of the recesses 52.1, 52.2; 54.1, 54.2 of the fastening part 39 of the mounting unit 36 and of the fastening body 41 of the end cap 37. In that case the mechanically positive connection 46.1 of the mounting unit 36 with the hollow profile 32 and the mechanically positive connection 46.2 of the end cap 37 with the hollow profile 32 is produced with simultaneous action of several press dies 51.1, 51.2, 51.3, 51.4 which engage the hollow profile 32 in opposite directions 95, 96 on longitudinal sides 86.1, 86.2 thereof facing away from one another (FIG. 22).

The press dies 51.1, 51.2, 51.3, 51.4 here all have an outer diameter 98 which is very much larger than the inner diameter 50 of the passage holes 49 of the hollow profile 32 with the still undeformed hole wall regions 48 and which is smaller than the inner diameter 99 of the passage holes 52; 52.1, 52.2 in the fastening limbs 71.1 and 71.2 of the fastening part 39 of the mounting unit 36 and also smaller than the inner diameter 100 of the passage holes 54.1, 54.2 in the insertion bodies 73.1, 73.2 of the fastening body 41 of the end cap 37.

In the illustrated exemplifying embodiment the press dies can, for example, have an outer diameter 98 of approximately 8 to 10 millimeters. This outer diameter 98 is preferably smaller than or the same size as the inner diameter 99 or 100, which is increased by twice the wall thickness of the undeformed hole wall region 48 of the hollow body 32, of the passage holes 52 and 54, respectively. In that case on deformation of the hollow profile 32, which consists of steel plate 29, there is no tearing out of material in the region of the hole edges 48 of the passage holes 49 by drawing or pressing these hole edges 48 into or against the wall parts, which bound the passage holes 52 and 54, of the mounting unit 36 and of the fastening body 41 of the end cap 37.

Proceeding from the starting situation shown in FIG. 22—in which the insertion unit 97 formed by the fastening body 41 of the end cap 37 and the fastening part 39 of the mounting unit 36 is inserted into the hollow profile 32 and in which the hole edges 48 of the passage holes 49 of the hollow profile are not yet deformed by the press dies 51.1, 51.2, 51.3, 51.4—for the purpose of production of a mechanically positive connection of the mounting unit 36 with the hollow profile 32 and also of the end cap 37 or the fastening body 41 thereof or with the hollow profile 32, as well as for the purpose of a mechanically positive connection of the mounting unit 36 with the end cap 37 or the fastening body 41 thereof, the press dies 51.1, 51.2 and preferably also the press dies 51.3 and 51.4 are moved in a direction 95, 96 opposite to one another and preferably parallel to the bore or hole axes of the passage holes 49, 52 and 54 until they come into contact with the outwardly facing outer boundary surfaces 89.1, 89.2 of the wall part 47.1, 47.2 of the hollow profile 32. In the course of continuing movement of the press dies 51.1, 51.2 and/or the press dies 51.3, 51.4 in an opposite direction 95, 96 the press dies 51.1, 51.2, 51.3, 51.4 move, with simultaneous deformation of the hole wall regions 48 of the hollow profile 32, in an inward direction and, in particular, with simultaneous widening of the opening of the passage holes 49 until ultimately a deformation or reshaping state is achieved, as is illustrated in FIG. 23. As readily apparent therefrom, now the passage holes 52 of the mounting unit 36 and also the passage holes 54.1 and 54.2 of the end cap 37 or the recess or hole edges thereof are engaged behind hole edges 48' which are integrally connected with the wall part 47.1, 47.2 of the hollow profile 32 and are drawn in to protrude inwardly, of the widened holes 49' of the hollow profile 32. A secure, firm and nevertheless simply producible mechanically positive connection between the parts to be connected, thus the mounting unit 36, the end cap 37 and the board unit 31, is thereby achieved.

Consequently, the invention also relates to a method of producing a toe board 30, particularly designed in accordance with the invention, for a scaffolding 10, for lateral enclosing of walk and/or work surfaces 16 of scaffolding platforms 15, with an elongate board unit 31 which is formed by or from a hollow profile 32 of steel, particularly of galvanised steel plate 29, which is closed at each of its ends 34.1, 34.2 which face away from one another in longitudinal direction 33-with the help of respective closure means 35 and which is provided with a mounting unit 36; 36.1, 36.2, which protrudes in longitudinal direction 33 beyond its respective end 34.1, 34.2 and consists of metal, preferably of steel, particularly of sheet steel 70, and which can serve for production of a connection with the scaffolding 10 and/or with an adjacent toe board 30, wherein the hollow profile 32 of the board unit 31 is closed at each of its ends 34.1, 34.2 by a respective end cap 37, which projects beyond the end 34.1, 34.2 of the hollow profile 32 and covers the end edges 38.1, 38.2 thereof and is composed preferably substantially or preferably entirely of plastics material and which comprises a fastening body 41, which is connected as one part or multiple part with the cover part 41 and is plugged into the hollow profile 32 and which is firmly connected with this and/or with the mounting unit 36 with the help of fastening means 42, and that the mounting unit 36 has a fastening part 39 which is inserted into the hollow profile 32 to penetrate, for preference, a recess 44, particularly a slot 44, of the cover part 40 and which is firmly connected with the hollow profile 32 of the board unit 31 with the help of fastening means 43, wherein the mounting unit 36 and/or the end cap 37 is or are connected by a pressing process, which produces a local deformation of a wall part 47.1, 47.2 of the hollow profile 32, with formation of a mechanically positive connection 46.1, 46.2 with the hollow profile 32.

The invention also relates to a scaffolding 10 comprising scaffolding platforms 15, which have walk and/or work surfaces 16, and vertical posts 11 with first connecting units 17 for connection of longitudinal rails 12, transverse rails 13 and/or diagonals with the help of second connecting units 22 as well as at least one toe board 30, 130 according to the invention. A part or a corner region of a scaffolding 10 of that kind is illustrated in FIGS. 26 and 27 as well as 39 and 40. The vertical posts 11 have at least one first connecting unit 17 in the form of a rosette 18, which is preferably formed as an apertured disc 19 and surrounds the vertical post 11 and which serves by recesses 20 for the fastening of further scaffolding elements, particularly a longitudinal rail 12, a transverse rail 13 and/or a diagonal (not shown in the figures). These scaffolding elements have, as second connecting units 17, a connecting head 23 which can be plugged onto the rosette 18 and which has a wedge opening 24 for plugging through of a connecting wedge 25 serving for tightening the respective scaffolding element 12, 13 to the rosette 18. The connecting head 23 has vertical outer boundary surfaces 26.1 and 26.2 running together in wedge-like manner at a wedge angle of preferably approximately 45°. The connecting head 23 additionally has an upper head part 27.1 and a lower head part 27.2, between which a slot 28, which is open towards the front, i.e. towards the post 11, for plugging of the connecting head 23 onto a rosette 18 is provided. A scaffolding 10 of that kind constructed from vertical posts 11, longitudinal rails 12 and transverse rails 13 and/or diagonals also comprises scaffolding platforms 15 having walk and/or work surfaces 16. Scaffolding platforms of that kind can be placed directly on the transverse rail 13 and/or on the longitudinal rail 12. They can also be provided with suspension aids such as suspension hooks, by means of which they can be placed on the transverse rails 13 and/or on the longitudinal rails 12 or hooked in. A tube connector 21 serving for connecting of a further vertical post is pressed into the vertical post 11 at the upper end.

FIG. 26 illustrates how a first toe board according to the invention, which here is a transverse toe board 30.1.1, is fixed to the scaffolding 10 or to parts thereof. As apparent, the mounting unit 36.1 or the fixing part 101 thereof extends in the space between the connecting wedge 25, which is driven into the wedge opening 24 of the connecting head 23, and the vertical post 11. It is achieved by the cranking of the mounting part 36.1 that the board unit 31 and also the end cap 37 are arranged above the walk and work surface 16 of the scaffolding covering 15. The board unit 31 and also the end cap 37 project beyond the walk and work surface 16 of the scaffolding covering 15 by substantial parts or entirely. In the illustrated exemplifying embodiment the board unit 31 of the toe board 30 rests on the walk and work surface 16 of the scaffolding platform 15. A gap is formed between the lower edge of the fixing part 101 of the mounting unit 36 and the connecting head 23.

The same scaffolding corner region as in FIG. 26 is illustrated in FIG. 27, wherein now apart from the one transverse toe board 30.1.1 a longitudinal toe board 30.1.2 is additionally arranged at an angle of approximately 90 degrees thereto and fixed to the scaffolding 10. For this purpose initially the longitudinal toe board 30.1.2 was mounted in such a manner that the transverse slot 84 of the associated mounting unit 36.1 faces upwardly. Subsequently, the transverse toe board 30.1.1 was fixed and hung in position and, in particular, in an arrangement in which the receiving slot 84 of the mounting unit 36.1 of the transverse toe board 30.1.1 is open downwardly. In this manner two toe boards can be fixed simply and securely to a scaffolding 10 in a corner region of that kind, wherein the respective narrow longitudinal end faces or end edges 87.1 thereof then lie at the same height.

An alternative exemplifying embodiment of a toe board 130 according to the invention is shown together with its part elements and in part views and/or cross sections in FIGS. 28 and 29 as well as 32 to 40. In that case, the same parts are provided with the same reference numerals as in the remaining figures. This toe board 130 comprises a hollow profile 132 according to FIGS. 32 to 35, an end cap 137 formed with a fastening body 141 (see FIGS. 36 to 40) and a mounting unit 136; 136.1 with a fastening part 139 (see, in particular, FIGS. 28 and 29 as well as 38 to 40). Apart from that, this toe board 130 differs from the afore-described exemplifying embodiment of a toe board 30 by, in particular, the fact that not only the fastening part 139 of the respective mounting unit 136; 136.1, but also the fastening body of the respective end cap 137 are fastened by means of tubular rivets 105 to the hollow profile 132 of the board unit 31. An improved load-bearing capability of the toe board 130 can thereby be achieved. In the illustrated exemplifying embodiment, according to a preferred refinement only two tubular rivets 105 are provided in each instance for fastening the respective mounting unit 136; 136.1 and the respective end cap 137 to the hollow profile 132 of the board unit 31. For this purpose the holes 149 in the hollow profile 132 are designed to be suitable and intended at the outset for reception of the tubular rivets 105 and, in particular, with an inner diameter 150 which, for preference, is slightly larger than the outer diameter of the tubular rivets 105 able to be inserted therein and therethrough. The inner diameter 150 is for preference approximately 11 millimeters (see FIGS. 32 to 35). The outer diameter of the tubular rivets 105 is preferably approximately 10 millimeters prior to the riveting or deforming.

In the finally mounted state of the toe board 130 according to this form of embodiment as shown in FIGS. 36 and 37 the respective tubular rivet 105 penetrates not only two of the holes 149, which are respectively arranged coaxially to one another, of the hollow profile 132, but also a passage hole 52.1 or 52.2 of the two passage holes 52.1, 52.2 of the fastening part 139 of the mounting unit 136; 136.1 as also in each instance two of the passage holes 54.1 and 54.2, which are arranged coaxially to one another, of the fastening body 141 of the end cap 137, so that the mounting unit 136 and the end cap 137 are mechanically positively connected, or connected with formation of a mechanically positive connection, with the hollow profile 132 in common by the tubular rivets 105 and fastened thereto. In this manner the mounting unit 136 and the end cap 137 are also mechanically positively connected, or connected with formation of a mechanically positive connection, with one another in common by the tubular rivets 105.

In the finally mounted state each tubular rivet 105 has at each of its two ends facing away from one another a respective rivet head 106.1 or 106.2. Each rivet head 106.1, 106.2 engages over a respective hole edge of the holes 149 of the hollow profile 132 at the outer side in such a manner that the tubular rivet 105 is connected in force-locking and shape-locking manner with the hollow profile 132 and fastened thereto.

The mounting and fastening of the mounting units 136; 136.1 and the end caps 137 at or to the hollow profile 132 of the board unit 31 with formation of a toe board 130 according to the invention is again carried out in three steps, wherein the first step and the second step correspond with the first and second steps already described in conjunction with the first exemplifying embodiment of a toe board 30.

Accordingly, in a first step the mounting units 136; 136.1 are each firmly connected with the end cap 137, wherein the fastening body 141 of the end cap 137 and the fastening part 139 of the mounting unit 136; 136.1 each form an insertion unit 197. Thus, initially the respective mounting unit 136; 136.1 is inserted, with its fastening limbs 71.1 and 71.2 foremost in insertion direction 62 (FIGS. 28 and 31), through the slot 45 of the cover part 140 of the end cap 137 into the respectively associated receiving cavity 78.1 and 78.2 of the end cap 137. In that case the free insertion ends of the fastening limbs 71.1. and 71.2 run on the part, which extends into the respective receiving cavity 78.1, 78.2, of the respective detent element 60 and in the course of the continuing insertion of the mounting unit 136; 136.1 into the end cap 137 the resilient detent elements 60 are pressed inwardly against the spring forces thereof. In the course of further plugging-on or plugging-in of the fastening part 139 of the mounting unit 136 in insertion direction 62 into the end cap 137 the respective detent element 60 ultimately automatically detents in the respective recess 61 of the fastening limbs 71.1 and 71.2 of the fastening part 139 of the mounting unit 136. The plugging of the fastening part 139 of the mounting unit 136 onto or into the end cap 137 is limited by an abutment 63 (cf. FIGS. 10 and 11), against which the fastening part 139 of the mounting unit 136 can abut during plugging onto or into the end cap 137 so that the mounting unit 136 in the mounted state is disposed in a position relative to the end cap 137 preferably predetermined by the position of the abutment 136. The abutment 63 and the detent element 60 of the end cap 137 are arranged at a spacing 64 which is the same as or slightly larger than the spacing 65 between the recess 61, which is associated with the detent element 60, of the fastening part 139 of the mounting unit 136 and an end edge 66, which is associated with the abutment 63, of the fastening part 139 of the mounting unit 136 (cf. FIGS. 11, 12 and 15). It can thereby be achieved that the detent element 60 in the mounted state detents, with formation of a mechanically positive connection, in the passage opening 61 of the fastening part 139 of the mounting unit 136 in such a manner that the fastening part 139 of the mounting unit 136 mounted on the end cap 137 is secured at least against withdrawal in a direction opposite to the insertion direction 62. In this manner there is obtained at the outset a unit, which can be handled simply and safely, consisting of the end cap 137 and the mounting unit 136 which is plugged thereinto and which is captively and preferably non-detachably connected with the end cap 137. This unit comprises an insertion unit 197, which is formed by the fastening part 139 of the mounting unit 136 and the fastening body 141 of the end cap 137.

In a second step the insertion unit 197 can be subsequently plugged into the hollow profile 132 of the board unit 31 (see the mounting position according to FIG. 36).

In a third step subsequent thereto the fastening part 139 of the mounting unit 136 and also the fastening body 141 of the end cap 137 are fixedly connected with the hollow body 132 and, in particular, in this exemplifying embodiment with the help of the tubular rivets 105 as already described in the foregoing in connection with FIGS. 36 and 37. It will be obvious that depending on need use can be made, instead of the mounting units 136.1, also the mounting units 136.2 shown in FIGS. 30 and 31.

In both exemplifying embodiments of the toe boards 30 and 130, thus not only a case of fastening of the fastening part 39 of the respective mounting unit 36; 36.1, 36.2 and/or of the fastening body 41 of the respective end cap 37 to the hollow profile 32 by means of locally deformed wall parts 47.1, 47.2 or hole edge regions 48', 49' of the hollow profile 32, but also in the case of fastening of the fastening part 139 of the respective mounting unit 136; 136.1 and/or the fastening body 141 of the respective end cap 137 by means of rivets 105, particularly tubular rivets 105, to the hollow profile 132, the mounting unit 36; 136 and/or the end cap 37; 137 is or are fastened exclusively by means of mechanical fastening means and free of welding to the hollow profile 32; 132 of the board unit 31.

The illustrations in FIGS. 39 and 40 correspond with the illustrations in FIGS. 26 and 27, wherein, however, now an alternative form of embodiment of a transverse toe board 130.1.1 is shown. The hollow profile 132 thereof is designed in accordance with the alternative variant of embodiment shown in FIGS. 32 to 35. A fastening body 141 of an end cap 137 (see FIGS. 36 to 38) and a fastening part 139 of a mounting unit 136.1 designed in accordance with the variant of embodiment shown in FIGS. 28 and 29 are fastened to the hollow profile 132 by means of tubular rivets 105.

Accordingly, in FIG. 39 there is shown a three-dimensional illustration of how a further toe board 130 according to the invention, which is here a transverse toe board 130.1.1, is fixed to the scaffolding 10 or to parts thereof. The mounting unit 136.1 or the fixing part 101.3 thereof extends in the space between the connecting wedge 25, which is driven into the wedge opening 24 of the connecting head 23, and the vertical post 11. It is achieved by the cranking of the mounting part 136.1 that the board unit 31 and also the end cap 137 are arranged above the walk and work surface 16 of the scaffolding platform 15. The board unit 31 and also the end cap 37 project beyond the walk and work surface 16 of the scaffolding covering 15 to substantial parts or entirely. In the illustrated exemplifying embodiment the board unit 31 of the toe board 30 rests on the walk and work surface 16 of the scaffolding covering 15. A gap is formed between the lower edge of the fixing part 101 of the mounting unit 36 and the connecting head 23.

The same scaffolding corner region as in FIG. 39 is illustrated in FIG. 40, wherein now two toe boards 130 are provided. In that case, apart from the transverse toe board 130.1.1 in addition a longitudinal toe board 130.1.2 is provided, which is arranged at an angle of, here, approximate 90 degrees thereto and fixed to the scaffolding 10. For this purpose initially the longitudinal toe board 130.1.2 was mounted in such a manner that the transverse slot 84 of the associated mounting unit 136.1 faces upwardly. Subsequently, the transverse toe board 130.1.1 was fixed and hung in place and, in particular, in an arrangement in which the receiving slot 84 of the mounting unit 136.1 of the transverse toe board 130.1.1 is open downwardly. In this manner two toe boards can be fixed simply and securely to a scaffolding 10 in a corner region of that kind, wherein the respective narrow longitudinal end faces or end edges 87.1 thereof then lie at the same height.

REFERENCE NUMERAL LIST

10 scaffolding
11 post
12 longitudinal rail
13 transverse rail
15 scaffolding platform
16 walk and work surface of 15
17 first connecting unit
18 rosette
19 apertured disc
20 recess
21 tube connector
22 second connecting unit
23 connecting head
24 wedge opening
25 connecting wedge
26.1 vertical outer boundary surface of 23
26.2 vertical outer boundary surface of 23
27.1 upper head part
27.2 lower head part
28 slot
29 steel plate
30 toe board
30.1 toe board
30.1.1 transverse toe board
30.1.2 longitudinal toe board
30.2 toe board
31 board unit
32 hollow profile
33 longitudinal direction
34 end of 32
34.1 first end of 32
34.2 second end of 32
35 closure means
36 mounting unit
36.1 mounting unit
36.2 mounting unit
37 end cap
38 end edge of 32
38.1 first end edge of 32
38.2 second end edge of 32
39 fastening part of 36
40 cover part
41 fastening body of 37
42 fastening means
43 fastening means
44 recess
45 slot
46.1 mechanically positive connection
46.2 mechanically positive connection
47.1 wall part of 32
47.2 wall part of 32
48 hole edge region of 49
48' hole edge of 49'
49 hole in 32
49' hole (deformed)
50 inner diameter of 49
51 press die
51.1 press die
51.2 press die
51.3 press die
51.4 press die
52 recess/passage hole
52.1 recess/passage hole
52.2 recess/passage hole
53 recess/passage hole of 52
54 recess/passage hole
54.1 recess/passage hole
54.2 recess/passage hole
55 recess/passage hole of 54
56 longitudinal axis of 32
57 protruding unit
58 protrusion
59 projection
60 detent element
61 recess/passage opening
62 insertion direction
63 abutment
64 spacing
65 spacing
66 end edge of 39
67 inner contour of 61
68 outer contour of 60
69.1 recess in 40
69.2 recess in 73.1, 73.2
70 sheet steel

71 fastening limb
71.1 first fastening limb
71.2 second fastening limb
72 spacing
73.1 first insertion body
73.2 second insertion body
74 spacing
75 end surface of 37
76 angle
77 abutment
78.1 receiving cavity
78.2 receiving cavity
79 blank
80.1 longitudinal rail
80.2 longitudinal rail
81.1 edge rail
81.2 edge rail
82.1 cross-section
82.2 cross-section
83.1 longitudinal end of 32
83.2 longitudinal end of 32
84 slot
85 slot base
86.1 first wide longitudinal side of 31
86.2 second wide longitudinal side of 31
87.1 first narrow longitudinal end face of 31
87.2 second narrow longitudinal end face of 31
88.1 longitudinal rib/corrugation (outward)
88.2 longitudinal rib/corrugation (outward)
88.3 longitudinal rib/corrugation (inward)
88.4 longitudinal rib/corrugation (inward)
89.1 outer boundary surface of 86.1
89.2 outer boundary surface of 86.2
90.1 spacing
90.2 spacing
91 double wall region
92 angle
93 butt joint
94 width of 91
95 press direction
96 press direction
97 insertion unit
98 outer diameter of 51
99 inner diameter of 52; 52.1, 52.2
100 inner diameter of 54; 54.1, 54.2
101 fixing part
101.1 fixing part
101.2 fixing part
101.3 fixing part
101.4 fixing part
102 hole
103 end edge
104 end of 37
105 rivet/tubular rivet
106.1 rivet head
106.2 rivet head
130 toe board
130.1.1 transverse toe board
130.1.2 longitudinal toe board
132 hollow profile
136 mounting unit
136.1 mounting unit
136.2 mounting unit
137 end cap
139 fastening part of 136
140 cover part
141 fastening body of 137
146.1 mechanically positive connection
146.2 mechanically positive connection
148 hole edge of 149
149 hole in 32
150 inner diameter of 149
157 projection unit
160 corrugation
160.1 corrugation
160.2 corrugation
161 bending over
162 bending over
163.1 limb
163.1 limb
164.1 limb
164.2 limb
197 insertion unit

The invention claimed is:

1. A toe board for a scaffolding, the toe board comprising:

an elongate board unit comprising a hollow profile of steel, the hollow profile having first and second ends facing away from one another in a longitudinal direction of the elongate board unit, the hollow profile being closed at the first and the second ends, the first and the second ends having respective end edges;

a first end cap closing the first end of the hollow profile and comprising a first cover part, the first cover part protruding beyond the first end of the hollow profile and covering the end edges of the first end of the hollow profile;

a second end cap closing the second end of the hollow profile and comprising a second cover part, the second cover part protruding beyond the second end of the hollow profile and covering the end edges of the second end of the hollow profile;

a first fastening body connected with the first cover part and inserted into the hollow profile;

a second fastening body connected with the second cover part and inserted into the hollow profile;

a first mounting unit protruding in the longitudinal direction beyond the first end of the hollow profile, said first mounting unit being composed of metal, having a first fastening part inserted into the hollow profile, and being able to connect with at least one of the scaffolding and an adjacent toe board;

a second mounting unit protruding in the longitudinal direction beyond the second end of the hollow profile, said second mounting unit being composed of metal, having a second fastening part inserted into the hollow profile, and being able to connect with at least one of the scaffolding and an adjacent toe board;

a first fastening device connecting the first fastening body with at least one of the hollow profile and the first mounting unit;

a second fastening device connecting the second fastening body with at least one of the hollow profile and the second mounting unit;

the first fastening device or a third fastening device connecting the hollow profile with the first fastening part; and the second fastening device or a fourth fastening device connecting the hollow profile with the second fastening part;

wherein the first fastening body of the first end cap is formed with a resilient detent element;

wherein the first mounting unit is mounted on the first end cap in a mounted state; and wherein, in the mounted state, the resilient detent element is in a recess of the first fastening part of the first mounting unit to form a shape-fit connection such that the first fastening part of the first mounting unit is secured at least against withdrawal in a direction opposite to a direction of insertion of the first fastening body of the first end cap into the hollow profile.

2. The toe board according to claim 1, wherein the first end cap has a slot; and wherein the first fastening part of the mounting unit is inserted into the slot of the first end cap to penetrate the hollow profile.

3. The toe board according to claim 2, wherein the first end cap has wall parts bounding the slot; and wherein the first fastening part is inserted into the slot such that the wall parts of the first end cap enclose the first fastening part over a full circumference of the first fastening part or substantially over the full circumference of the first fastening part.

4. The toe board according to claim 1, wherein the first fastening body is composed of plastics material and is connected integrally with the first cover part.

5. The toe board according to claim 1, wherein the first cover part is formed substantially from or by a thermoplastic plastics material.

6. The toe board according to claim 1, wherein at least one of the first end cap and the first fastening body is composed substantially of a plastics material, the plastics material being:

filled with fillers, reinforced by reinforcing materials, or both filled with fillers and reinforced by reinforcing materials.

7. The toe board according to claim 1, wherein at least one of the first mounting unit and the first end cap is connected with the hollow profile with a formation of a second shape-fit connection.

8. The toe board according to claim 1, wherein the first mounting unit and the first end cap are connected together with a formation of a second shape-fit connection.

9. The toe board according to claim 1, wherein at least one of the first mounting unit and the first end cap is connected, free of welding, with the hollow profile of the elongate board unit.

10. The toe board according to claim 1, wherein at least one of the first mounting unit and the first end cap is fastened via rivets to the hollow profile of the elongate board unit.

11. The toe board according to claim 7, wherein the formation of the second shape-fit connection is formed by a pressing process producing a local deformation of a wall part of the hollow profile.

12. The toe board according to claim 7, wherein the hollow profile comprises a hole edge region of a hole provided in a wall part of the hollow profile, wherein the formation of the second shape-fit connection is formed by drawing in or pressing in the hole edge region so that the hole edge region is positioned into a second recess of at least one of the fastening part of the first mounting unit and the fastening body of the first end cap.

13. The toe board according to claim 1, wherein the first fastening part of the first mounting unit is configured to be plugged onto or into the first end cap so that the plugging of the first fastening part onto or into the first end cap presses the resilient detent element of the first fastening body inwardly against spring forces of the resilient detent element; and wherein, during further plugging on or in of the first fasting part, the resilient detent element automatically detents in the recess of the first fastening part of the first mounting unit.

14. The toe board according to claim 1, wherein the first end cap has an abutment; and wherein the first fastening part of the first mounting unit can abut against the abutment during plugging of the first fastening part onto or into the first end cap so that the first mounting unit in a mounted state is disposed in a position relative to the first end cap predetermined by a position of the abutment.

15. The toe board according to claim 1, wherein the recess of the first fastening part is formed as a slot, the slot extending in the direction of insertion of the first mounting unit into the first end cap and having an inner contour; and wherein the resilient detent element has an outer contour corresponding with the inner contour of the slot.

16. The toe board according to claim 1, wherein the first fastening part is formed with at least two fastening limbs arranged at a spacing from one another.

17. The toe board according to claim 16, wherein each fastening limb of the at least two fastening limbs is formed with:

at least one first recess serving for fastening of the respective fastening limb to the hollow profile, and at least one second recess serving for fixing of the respective fastening limb relative to the first end cap.

18. The toe board according to claim 1, wherein the first fastening body is formed with at least two insertion bodies arranged at a spacing from one another.

19. The toe board according to claim 18, wherein the first fastening part is formed with at least two fastening limbs; and wherein a number of the at least two insertion bodies corresponds with a number of the at least two fastening limbs.

20. The toe board according to claim 1, wherein the first end cap has an end facing away from the hollow profile in the longitudinal direction; and wherein the first end cap is formed to be chamfered at an angle at the end facing away from the hollow profile in the longitudinal direction.

21. The toe board according to claim 1, wherein the first cover part covers the end edges of the first end of the hollow profile in that a portion of the first cover part covers the end edges of the first end;

wherein the portion of the first cover part forms an abutment; and wherein the abutment can be brought into contact with the end edges of the first end of the hollow profile or bears against the end edges of the first end of the hollow profile.

22. The toe board according to claim 1, wherein the end edges of the first end of the hollow profile span a plane arranged perpendicularly to a length direction of the toe board or perpendicularly to a longitudinal axis of the hollow profile.

23. The toe board according to claim 1, wherein the hollow profile is formed with at least one longitudinal beam.

24. The toe board according to claim 23, wherein the at least one longitudinal beam is an edge beam.

25. The toe board according to claim 23, wherein the at least one longitudinal beam comprises first and second longitudinal beams comprising edge beams.

26. The toe board according to claim 1, wherein the hollow profile is composed of a folded blank of a steel plate.

27. The toe board according to claim 1, wherein, via a first region, the first mounting unit protrudes in the longitudinal direction beyond the first end of the hollow profile;

wherein the elongate board unit has narrow longitudinal end faces extending in the longitudinal direction of the elongate board unit; and wherein the first region includes a slot extending substantially perpendicularly to a longitudinal axis of the hollow profile, and open towards one of the narrow longitudinal end faces of the elongate board unit.

28. The toe board according to claim 1, wherein the elongate board unit has first and second wide longitudinal sides facing away from one another and longitudinal ribs on the first and second wide longitudinal sides, the longitudinal ribs:

extending over or substantially over an entire length of the elongate board unit, and enabling stacking of several toe boards one on the other to form a shape-fit connected stack, wherein displacement of each toe board in the stack perpendicularly to a length direction of the toe board is hindered or prevented.

29. The toe board according to claim 28, wherein at least one first longitudinal rib of the longitudinal ribs extends upwardly of an outer boundary surface of the first wide longitudinal side of the elongate board unit; and wherein at least one second longitudinal rib of the longitudinal ribs extends downwardly of an outer boundary surface of the second wide longitudinal side of the elongate board unit.

30. The toe board according to claim 28, wherein the hollow profile comprises at least one longitudinal beam; and wherein the longitudinal ribs are arranged in a region of the at least one longitudinal beam.

31. The toe board according to claim 28, wherein the elongate board unit has first and second narrow longitudinal side end faces;

wherein the longitudinal ribs are associated with at least one of the first and second narrow longitudinal side end faces; and wherein the longitudinal ribs each have a spacing from the at least one of the first and second narrow longitudinal side end faces, the spacing enabling gripping of the elongate board unit, by a hand, from the at least one of the first and second narrow longitudinal end faces in such a manner that:

at least one of the longitudinal ribs on the first wide longitudinal side of the elongate board unit can be gripped behind by at least one first finger of the hand, or at least one first finger of the hand can engage in at least one of the longitudinal ribs on the first wide longitudinal side of the elongate board unit, whilst simultaneously another finger of the hand can grip the second wide longitudinal side of the elongate board unit.

32. The toe board according to claim 31, wherein the spacing is between 15 and 35 millimeters.

33. The toe board according to claim 1, wherein the first mounting unit is formed from sheet steel;

wherein, via a first region, the first mounting unit protrudes in the longitudinal direction beyond the first end of the hollow profile; and wherein the first mounting unit is bent in the first region transversely to the longitudinal direction.

34. The toe board according to claim 1, wherein the first mounting unit comprises a steel plate bent at least twice.

35. The toe board according to claim 1 in combination with the scaffolding, the scaffolding comprises surfaces configured to walk or work thereon, the scaffolding having vertical posts with first connecting units for connection to second connecting units of at least one of longitudinal rails, transverse rails and diagonals.

36. The toe board and scaffolding according to claim 35, wherein the first connecting units are constructed as a rosette surrounding a vertical post of said vertical posts and having recesses, and wherein the second connecting units comprise a connecting head configured to be plugged onto the rosette and have at least one wedge opening for insertion of a connecting wedge for tightening to the rosette.

37. The toe board and scaffolding according to claim 36, wherein the connecting head has vertical outer boundary surfaces, an upper head part and a lower head part, wherein a forwardly open slot for plugging of the connecting head onto the rosette is provided between the upper head part and the lower head part.

38. A method for producing the toe board according to claim 1, the method comprising the steps of:

connecting the first fastening body with the first cover part;

inserting the first fastening body into the hollow profile;

connecting the second fastening body with the second cover part;

inserting the second fastening body into the hollow profile;

closing the first end of the hollow profile via the first end cap;

closing the second end of the hollow profile via the second end cap;

inserting the first fastening part of the first mounting unit into the hollow profile;

inserting the second fastening part of the second mounting unit into the hollow profile;

connecting the first fastening body with at least one of the hollow profile and the first mounting unit via the first fastening device;

connecting the second fastening body with at least one of the hollow profile and the second mounting unit via the second fastening device;

connecting the hollow profile with the first fastening part via the first or the third fastening device; and connecting the hollow profile with the second fastening part via the second or the fourth fastening device;

mounting the first mounting unit on the first end cap to produce the mounted state; and performing a pressing process producing a local deformation of a wall part of the hollow profile to provide a second shape-fit connection between the hollow profile and at least one of the first mounting unit and the first end cap.

39. The method according to claim 38, wherein the second shape-fit connection is produced by drawing in or pressing in a hole edge of a hole provided in the wall part of the hollow profile via a press die pressed into a second recess of the fastening part of at least one of the first mounting unit and the fastening body of the first end cap.

40. The method according to claim 38, wherein the second shape-fit connection is produced by several press dies engaging the hollow profile on longitudinal sides of the hollow profile facing away from one another.

41. A method for producing the toe board according to claim 1, the method comprising the steps of:

connecting the first fastening body with the first cover part;

inserting the first fastening body into the hollow profile;

connecting the second fastening body with the second cover part;

inserting the second fastening body into the hollow profile;

closing the first end of the hollow profile via the first end cap;

closing the second end of the hollow profile via the second end cap;

inserting the first fastening part of the first mounting unit into the hollow profile;

inserting the second fastening part of the second mounting unit into the hollow profile;

connecting the first fastening body with at least one of the hollow profile and the first mounting unit via the first fastening device;

connecting the second fastening body with at least one of the hollow profile and the second mounting unit via the second fastening device;

connecting the hollow profile with the first fastening part via the first or the third fastening device; and connecting the hollow profile with the second fastening part via the second or the fourth fastening device;

mounting the first mounting unit on the first end cap to produce the mounted state; and wherein at least one of the first mounting unit and the first end cap is fastened, free of welding, to the hollow profile of the board unit.

42. A method for producing the toe board according to claim 1, the method comprising the steps of:

connecting the first fastening body with the first cover part;

inserting the first fastening body into the hollow profile;

connecting the second fastening body with the second cover part;

inserting the second fastening body into the hollow profile;

closing the first end of the hollow profile via the first end cap;

closing the second end of the hollow profile via the second end cap;

inserting the first fastening part of the first mounting unit into the hollow profile;

inserting the second fastening part of the second mounting unit into the hollow profile;

connecting the first fastening body with at least one of the hollow profile and the first mounting unit via the first fastening device;

connecting the second fastening body with at least one of the hollow profile and the second mounting unit via the second fastening device;

connecting the hollow profile with the first fastening part via the first or the third fastening device; and connecting the hollow profile with the second fastening part via the second or the fourth fastening device;

mounting the first mounting unit on the first end cap to produce the mounted state;

wherein at least one of the first mounting unit and the first end cap is fastened to the hollow profile of the elongate board unit via rivets.

43. The method according to claim 38, further comprising the following steps:

initially connecting the first mounting unit and the first end cap together, wherein the first fastening body of the first end cap and the first fastening part of the first mounting unit form an insertion unit;

subsequently inserting the insertion unit into the hollow profile; and subsequently connecting the first fastening part of the first mounting unit with the hollow profile.

44. The method according to claim 41, further comprising the following steps:

initially connecting the first mounting unit and the first end cap together, wherein the first fastening body of the first end cap and the first fastening part of the first mounting unit form an insertion unit;

subsequently inserting the insertion unit into the hollow profile; and subsequently connecting the first fastening part of the first mounting unit with the hollow profile.

45. The method according to claim 42, further comprising the following steps:

initially connecting the first mounting unit and the first end cap together, wherein the first fastening body of the first end cap and the first fastening part of the first mounting unit form an insertion unit;

subsequently inserting the insertion unit into the hollow profile; and subsequently connecting the first fastening part of the first mounting unit with the hollow profile.

* * * * *